US009556869B2

(12) United States Patent
Hashiba et al.

(10) Patent No.: US 9,556,869 B2
(45) Date of Patent: Jan. 31, 2017

(54) COMPACT STRUCTURE OF GEAR PUMP DESIGNED TO MINIMIZE LOSS OF PUMPING TORQUE

(71) Applicants: DENSO CORPORATION, Kariya, Aichi-pref. (JP); Nippon Soken, Inc., Nishio, Aichi-pref. (JP); Advics Co., Ltd., Kariya, Aichi-pref. (JP)

(72) Inventors: Takashi Hashiba, Nishio (JP); Naoki Hakamada, Anjo (JP); Kazunori Uchiyama, Okazaki (JP); Takahiro Naganuma, Kariya (JP); Tomoaki Kawabata, Takahama (JP); Kunihito Ando, Okazaki (JP)

(73) Assignees: NIPPON SOKEN, INC., Nishio, Aichi-pref. (JP); DENSO CORPORATION, Kariya, Aichi-pref. (JP); ADVICS CO., LTD., Kariya, Aichi-pref. (JP)

( * ) Notice: Subject to any disclaimer, the term of this patent is extended or adjusted under 35 U.S.C. 154(b) by 256 days.

(21) Appl. No.: 14/552,719

(22) Filed: Nov. 25, 2014

(65) Prior Publication Data

US 2015/0152865 A1 Jun. 4, 2015

(30) Foreign Application Priority Data

Nov. 29, 2013 (JP) ..... 2013-248194

(51) Int. Cl.
*F01C 19/00* (2006.01)
*F04C 15/00* (2006.01)
(Continued)

(52) U.S. Cl.
CPC ..... *F04C 15/0023* (2013.01); *F01C 19/005* (2013.01); *F04C 2/10* (2013.01); *F04C 2/18* (2013.01)

(58) Field of Classification Search
CPC ..... F01C 19/005; F04C 15/0023; F04C 2/10; F04C 2/18; F04C 14/265; F04C 15/0026
See application file for complete search history.

(56) References Cited

U.S. PATENT DOCUMENTS 6,273,527 B1 * 8/2001 Yamaguchi ..... B60T 8/4031 277/361
6,905,321 B2 * 6/2005 Uchiyama ..... B60T 8/4031 418/102

(Continued)

FOREIGN PATENT DOCUMENTS

JP 2006-088896 4/2006
JP 2012-052455 3/2012
JP 2014-025352 2/2014

*Primary Examiner* — Jesse Bogue
(74) *Attorney, Agent, or Firm* — Harness, Dickey & Pierce, P.L.C.

(57) ABSTRACT

A gear pump apparatus is equipped with a pump and a sealing mechanism which is made up of an outer member, an inner member, and a rubber member fit between the outer and inner members. The inner member has a pressure-exerted surface to which pressure, as produced by contact of the rubber member with the inner member arising from application of discharge pressure of the pump, is applied. The pressure-exerted surface has a flange which creates thrust to move the inner member away from the gear pump, thereby bringing the inner member against an inner wall of a pump casing to develop a hermetical seal between a high-pressure region and a low-pressure region within the pump casing. This eliminates the leakage of pressure and ensures torque required for a pumping operation of the pump.

6 Claims, 11 Drawing Sheets

(51) Int. Cl.
*F04C 2/10* (2006.01)
*F04C 2/18* (2006.01)

(56) References Cited

U.S. PATENT DOCUMENTS

| | | | | |
|---|---|---|---|---|
| 7,399,171 | B2 * | 7/2008 | Yamaguchi | B60T 8/4031 418/132 |
| 2006/0077052 | A1 | 4/2006 | Matsuoka | |
| 2010/0060074 | A1 * | 3/2010 | Yamaguchi | B60T 8/3655 303/116.4 |
| 2012/0051959 | A1 | 3/2012 | Nakamura et al. | |
| 2012/0051960 | A1 * | 3/2012 | Nakamura | F04C 15/0038 418/104 |
| 2014/0030132 | A1 * | 1/2014 | Naganuma | F04C 18/08 418/191 |
| 2016/0010645 | A1 * | 1/2016 | Hashiba | B60T 7/042 418/140 |

* cited by examiner

COMPACT STRUCTURE OF GEAR PUMP DESIGNED TO MINIMIZE LOSS OF PUMPING TORQUE

CROSS REFERENCE TO RELATED DOCUMENT

The present application claims the benefit of priority of Japanese Patent Application No. 2013-248194 filed on Nov. 29, 2013, the disclosure of which is incorporated herein by reference.

BACKGROUND OF THE INVENTION

1. Technical Field of the Invention

This disclosure relates generally to a gear pump apparatus, such as a trochoid pump, which is designed to use the meshing of gears to pump fluid by displacement and may be employed with automotive brake systems.

2. Background Art

When a pump body of typical gear pumps is joined using screws to a housing or casing to make a pump unit, tightening of the screws usually results in a variation in axial force acting on parts of the gear pump so as to eliminate air gaps among them. In order to minimize such a variation in axial force, a plate spring is disposed on the top or base of the pump body. The installation of the plate spring, however, requires a space great enough for arranging the plate spring within the gear pump apparatus, thus resulting in a difficulty in minimizing the overall size of the gear pump apparatus.

Japanese Patent First Publication No. 2012-52455 teaches a gear pump designed to have discharge chambers formed outside axial ends of a pump body so as to produce discharge pressure which will press parts of the pump against each other. This eliminates air gaps among the parts of the pump and the need for use of the plate spring which gets in the way of reducing the size of the pump.

The above gear pump includes an outer shell of the housing and ring-shaped sealing mechanisms. The outer shell defines the discharge chambers outside the axial ends of the pump body. The sealing mechanisms are disposed inside the outer shell and pressed against rotors in an axial direction of the rotors, respectively, to hermetically seal the discharge chambers. This structure, however, has the risk of creating an air gap between the outer shell of the housing and each of the sealing mechanisms. Specifically, each of the sealing mechanisms is made up of a plurality of parts. Dimensions of the parts in the axial direction of the rotors are determined in light of the distance between an axial end of a corresponding one of the rotors and the outer shell, but however, variations in dimensions within tolerances of the parts, elastic deformation of the parts resulting from exertion of the discharge pressure, or creep of the parts may lead to the air gaps. The air gaps may result in leakage of pressure or cause elastic parts (e.g., O-rings) of the sealing mechanism to elastically deform thereinto, which will lead to a decrease in durability of the sealing mechanisms.

In order to alleviate the above problems, the axial dimensions of the parts arranged inside the outer shell of the housing may be determined to be great. This, however, causes the rotors to be pressed in the axial direction thereof before the gear pump generates the discharge pressure, thus requiring an increase in torque for driving the rotors, which will result in a loss of pumping torque of the pump.

SUMMARY OF THE INVENTION

It is therefore an object of this disclosure to provide an improved structure of a gear pump apparatus which is designed to minimize a loss of pumping torque.

According to one aspect of the invention, there is provided a gear pumping apparatus which may be employed in a brake system for automotive vehicles. The gear pump apparatus which comprises: (a) a gear pump which includes a first gear and a second gear meshing with the first gear, the first and second gears being rotated through a drive shaft to suck and discharge fluid in a pumping operation; (b) a casing which has defined therein a chamber in which the first and second gears are mounted; and (c) a sealing mechanism which is disposed between an outer wall of the casing and the gear pump. The sealing mechanism works to create a hermetical seal between a low-pressure region and a high-pressure region. The low-pressure region includes an intake side of the gear pump into which the fluid is sucked and a peripheral region of the drive shaft. The high-pressure region includes a discharge side from which the fluid is discharged. The sealing mechanism includes an annular rubber member, an outer member, and an inner member. The annular rubber member surrounds the low-pressure region to create a hermetical seal between the low-pressure region and the high-pressure region. The outer member is placed outside the annular rubber member in contact with one of axial ends of each of the first and second gears of the pump. The inner member has an outer peripheral wall on which the annular rubber member is fit and is disposed inside the outer member. The inner member is arranged in contact with an inner surface of the outer wall of said casing. The inner surface is located on an opposite side of the inner member to said gear pump. The outer peripheral wall of the inner member has formed thereon a protrusion which is shaped to have a pressure-exerted surface to which pressure, as produced by deformation of the annular rubber member arising from application of discharge pressure of said gear pump, is applied to create thrust to move the inner member toward the inner surface of the outer wall of said casing. The protrusion also works to increase the thrust with an increase in pressure exerted by the annular rubber member on the pressure-exerted surface which arises from a rise in the discharge pressure. The inner member is greater in Young's modulus than the outer member.

Specifically, when the gear pump is in a pumping operation, the pressure-exerted surface of the inner member will be pressed in a direction perpendicular to the pressure-exerted surface to produce the thrust to push the inner member away from the gear pump, thereby bringing the inner member into contact abutment with the inner surface of the outer wall of the casing to eliminate an air gap therebetween. The rubber member is pressed by the discharge pressure against the inner surface of the outer wall of the casing, thereby hermetically isolate between a low-pressure region inside the rubber member and a high-pressure region outside the rubber member. This avoids the leakage of pressure and unusual deformation of the rubber member caused by thrusting thereof into the air gap which will lead to a decrease in durability of the sealing mechanisms. The rubber member also works to change the pressure acting on the pressure-exerted surface of the inner member with a change in discharge pressure of the gear pump, thereby further reducing the loss of the pumping torque.

The inner member is made from material which is higher in Young's modulus than that of the outer member, thus decreasing the amount by which the inner member is deformed when it is gripped by the outer member subjected to the discharge pressure. This ensures the stability of pressure acting on surfaces of the inner member and the outer member which are placed in contact with each other and also causes the degree of friction between the outer member and the inner member which serves as a braking force acting on the outer member when the outer member is urged toward the gear pump to be increased with an increase in pressure, as exerted by the outer member on the inner member, thus reducing pressure exerted by the outer member on the gear pump to decrease the loss of torque required for the pumping operation of the gear pump.

The material of the rubber member may be a relatively soft elastomer which includes a resin-based material. The phrase "relatively soft" means that the inner member is softer than the gear pump, the casing, and the outer member.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 4(*b*) is a sectional view, as taken along the line IVb-IVb' in FIG. 4(*a*);

FIG. 5(*b*) is a side view of the outer member in FIG. 5(*a*);

FIG. 5(*c*) is a back view of the outer member in FIG. 5(*a*);

FIG. 5(*d*) is a sectional view, as taken along the line Vd-Vd' in FIG. 5(*a*);

FIG. 13(*b*) is a sectional view, as taken along the line XIIb-XIIb' in FIG. 13(*a*);

FIG. 14(*b*) is a sectional view, as taken along the line XIVb-XIVb' in FIG. 14(*a*);

FIG. 15(*b*) is a sectional view, as taken along the line XVb-XVb' in FIG. 15(*a*)

DESCRIPTION OF THE PREFERRED EMBODIMENTS

Embodiments will be described below with reference to the drawings wherein like reference numbers refer to like or equivalent parts in several views.

First Embodiment

Figure 1:
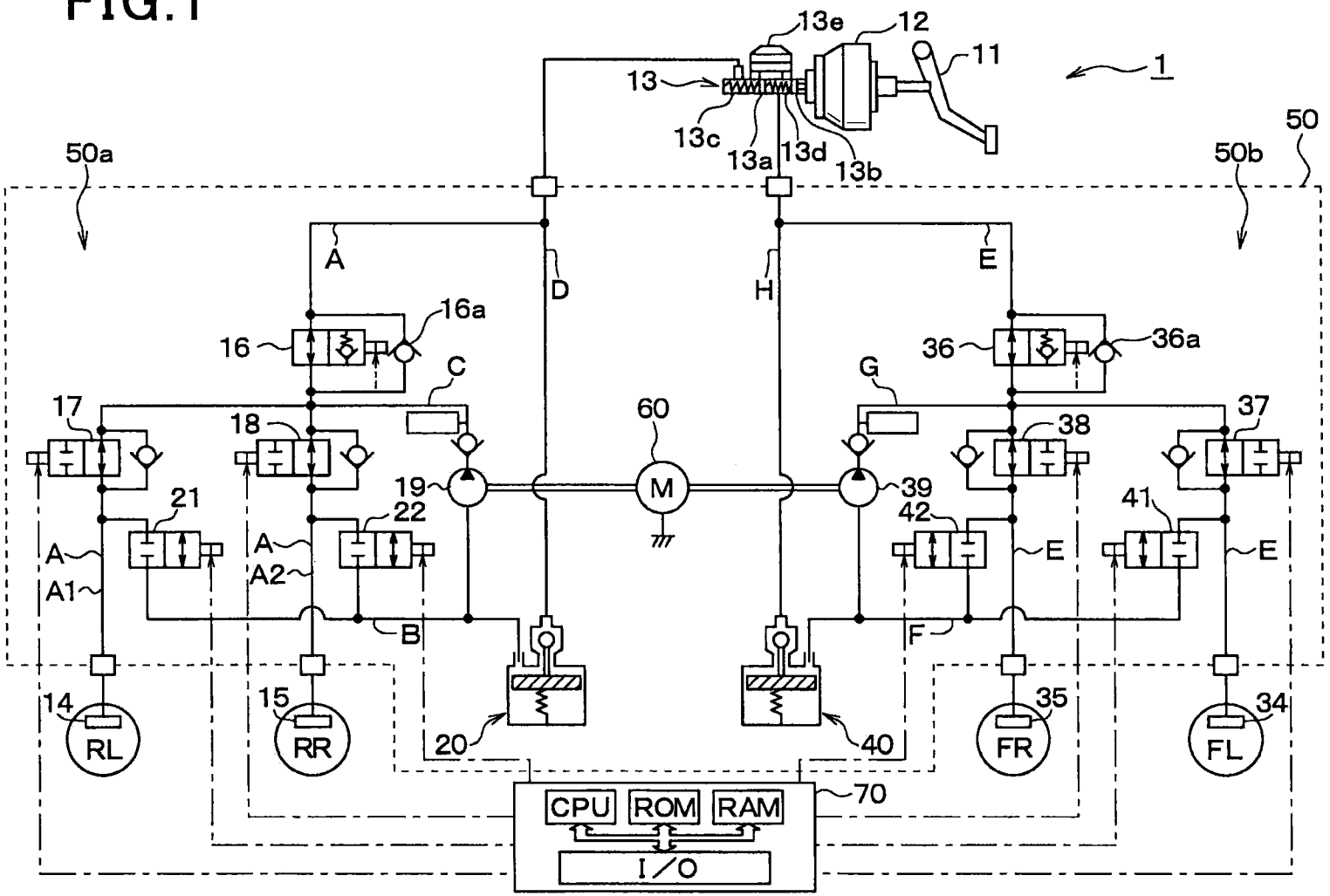
FIG. 1 is a circuit diagram which illustrates a brake system equipped with a gear pump apparatus according to the first embodiment of the invention.

Referring to FIG. 1, there is shown an automotive brake system equipped with a gear pump apparatus according to the first embodiment of the invention. The brake system, as referred to herein, is used with an automotive vehicle equipped with a front/rear split hydraulic system.

The brake system includes a brake device 1 which is equipped with a brake pedal 11 (i.e., a brake actuating member) to be depressed by a vehicle occupant or driver for applying the brakes to the vehicle, a brake booster 12, a master cylinder 13, wheel cylinders 14, 15, 34, and 35, and a brake pressure control actuator 50. The master cylinder 13, as will be described later in detail, works to produce a braking hydraulic pressure in response to an operation of the brake actuating member (i.e., the brake pedal 11). The actuator 50 has a brake ECU (Electronic Control Unit) 70 installed therein. The brake ECU 70 works to control the braking force, as developed by the brake device 1.

The brake pedal 11 is connected to the brake booster 12 and the master cylinder 13. When the driver of the vehicle depresses the brake pedal 11, the brake booster 12 works to boost the pressure applied to the brake pedal 11 and push master pistons 13*a* and 13*b* installed in the master cylinder 13, thereby developing the same pressure (which will also be referred to as M/C pressure below) in a primary chamber 13*c* and a secondary chamber 13*d* which are defined by the master pistons 13*a* and 13*b*. The M/C pressure is then transmitted to the wheel cylinders 14, 15, 34, and 35 through the actuator 50 serving as a brake hydraulic pressure controller. The master cylinder 13 is equipped with a master reservoir 13*e* which has fluid paths communicating with the primary chamber 13*c* and the secondary chamber 13*d*, respectively.

The actuator 50 includes a first hydraulic circuit 50*a* and a second hydraulic circuit 50*b*. The first hydraulic circuit 50*a* is a rear hydraulic circuit working to control the brake fluid to be applied to the rear right wheel RR and the rear left wheel RL. The second hydraulic circuit 50*b* is a front hydraulic circuit working to control the brake fluid to be applied to the front left wheel FL and the front right wheel FR.

The first hydraulic circuit 50*a* is smaller in consumed amount of brake fluid (i.e., the capacity of a caliper) than the second hydraulic circuit 50*b*, but identical in structure.

Therefore, for the brevity of disclosure, the following discussion will refer only to the first hydraulic circuit 50*a* below.

The first hydraulic circuit 50*a* is equipped with a main hydraulic line A (also called a main hydraulic path below) through which the M/C pressure is transmitted to the wheel cylinder 14 for the rear left RL and the wheel cylinder 15 for the rear right wheel RR to produce wheel cylinder pressures (which will also be referred to as W/C pressures below) which create the braking force.

The main hydraulic line A has disposed therein a differential pressure control valve 16 which is operable in either of two modes: an open mode and a pressure-difference mode. In a normal braking mode where it is required to produce the braking force as a function of an amount of depression of the brake pedal 11 by the driver, that is, a motion control mode is entered, the valve position of the differential pressure control valve 16 is placed in the open mode. The differential pressure control valve 16 is equipped with a solenoid coil. When the solenoid coil is energized electrically, the valve position of the differential pressure control valve 16 is moved and placed in the pressure-difference mode. Specifically, when the current supplied to the solenoid coil is increased, it sets the differential pressure control valve 16 to the pressure-difference mode.

When entering the pressure-difference mode, the differential pressure control valve 16 works to control the flow of the braking fluid to elevate the W/C pressures in the wheel cylinders 14 and 15 above the M/C pressure. When the W/C pressures in the wheel cylinders 14 and 15 become higher than the M/C pressure by a set pressure difference, as developed by the differential pressure control valve 16, it permits the brake fluid to flow from the wheel cylinders 14 and 15 to the master cylinder 13. Usually, the W/C pressures in the wheel cylinders 14 and 15 are held from elevating above the M/C pressure by more than the set pressure difference.

The main hydraulic line A is equipped with two branch lines: a hydraulic line A1 and a hydraulic line A2 which extend downstream of the differential pressure control valve 16 to the wheel cylinders 14 and 15, respectively. The hydraulic line A1 is equipped with a first pressure-increasing valve 17 to increase the pressure of the brake fluid supplied to the wheel cylinder 14. Similarly, the hydraulic line A2 is equipped with a second pressure-increasing valve 18 to increase the pressure of the brake fluid supplied to the wheel cylinder 15.

Each of the first and second pressure-increasing valves 17 and 18 is implemented by a normally-open two-position valve which is opened or closed by the brake ECU 70 to control increasing of the braking hydraulic pressure (i.e., the pressure of the brake fluid applied to the wheel cylinder 14 or 15). Specifically, when a solenoid coil installed in the first pressure-increasing valve 17 is deenergized, the first pressure-increasing valve 17 is opened. Alternatively, the solenoid coil is energized, the first pressure-increasing valve 17 is closed. The same is true for the second pressure-increasing valve 18.

The actuator 50 also includes a hydraulic line B which extends as a pressure-reducing path between a junction of the pressure-increasing valve 17 and the wheel cylinder 14 and a pressure control reservoir 20 and between a junction of the pressure-increasing valve 18 and the wheel cylinder 15 and the pressure control reservoir 20. The hydraulic line B has installed therein first and second pressure-reducing valves 21 and 22 which are each implemented by a normally closed two-position solenoid valve to control decreasing of the braking hydraulic pressure (i.e., the pressure of the brake fluid applied to the wheel cylinder 14 or 15).

The actuator 50 also includes a hydraulic line C which extends as a recirculating path between the pressure control reservoir 20 and the hydraulic line A. The hydraulic line C is equipped with a self-priming gear pump 19 which is driven by an electric motor 60 to suck the brake fluid from the pressure control reservoir 20 and feed it to the master cylinder 13 or the wheel cylinders 14 and 15. The electric motor 60 is driven by controlling the energization of a motor relay (not shown).

The actuator 50 also includes a hydraulic line D which extends as a sub-hydraulic line between the pressure control reservoir 20 and the master cylinder 13. In the motion control mode, the gear pump 19 works to suck the brake fluid from the master cylinder 13 through the hydraulic line D and output it to a required one of the wheel cylinders 14 and 15 through the hydraulic line A to increase the W/C pressure of a target one of the wheels.

The second hydraulic circuit 50*b* is, as already described, substantially identical in structure with the first hydraulic circuit 50*a*. Specifically, the second hydraulic circuit 50*b* is equipped with a differential pressure control valve 36, third and fourth pressure-increasing valves 37 and 38, third and fourth pressure-reducing valves 41 and 42, a pressure control reservoir 40, and a gear pump 39. The differential pressure control valve 36 corresponds to the differential pressure control valve 16. The third and fourth pressure-increasing valves 37 and 38 correspond to the first and second pressure-increasing valves 17 and 18. The third and fourth pressure-reducing valves 41 and 42 correspond to the first and second pressure-reducing valves 21 and 22. The pressure control reservoir 40 corresponds to the pressure control reservoir 20. The gear pump 39 corresponds to the gear pump 19. The second hydraulic circuit 50*b* also includes hydraulic lines E, F, G, and H which correspond to the hydraulic lines A, B, C, and D. The second hydraulic circuit 50*b* serving as the front hydraulic circuit, as described above, has a hydraulic capacity to supply the brake fluid to the wheel cylinders 35 and 34 which is greater than that of the first hydraulic circuit 50*a* to supply the brake fluid to the wheel cylinders 14 and 15, so that the braking force for the front wheels will be greater in magnitude than that for the rear wheels.

The brake ECU 70 is implemented by a typical microcomputer made up of a CPU, a ROM, a RAM, an I/O device, etc. The brake ECU 70 executes various operations, as instructed by programs stored in the ROM, to control the motion of the vehicle in the motion control mode such as an anti-lock brake control mode or an electronic stability control mode. Specifically, the brake ECU 70 calculates physical quantities, as indicated by outputs of sensors (not shown), and determines whether the motion control mode should be performed or not using the calculated physical quantities. When it is required to perform the motion control mode, the brake ECU 70 calculates a controlled variable for a target one of the wheels, that is, a target W/C pressure to be developed in a corresponding one of the wheel cylinders 14, 15, 35, or 34 and then controls the operations of the valves 16 to 18, 21, 22, 36 to 38, 41, and 42 and the operation of the motor 60 which drives the gear pumps 19 and 39 to achieve the target W/C pressure.

When the master cylinder 13 produces no pressure, for example, in the traction control mode or the electronic stability control mode, the brake ECU 70 activates the gear pump 19 and 39 and places the first and second differential pressure control valves 16 and 36 in the pressure difference mode, thereby supplying the brake fluid downstream of the differential pressure control valves 16 and 36, that is, to the wheel cylinders 14, 15, 34, and 35 through the hydraulic lines D and H. The brake ECU 70 then selectively controls the operations of the first to fourth pressure-increasing valves 17, 18, 37, and 38 or the first to fourth pressure-reducing valves 21, 22, 41, and 42 to increase or decrease the W/C pressure in a target one(s) of the wheel cylinders 14, 15, 34, and 35 into agreement with a target value.

When the anti-lock brake control mode is entered, that is, the anti-lock brake system (ABS) is activated, the brake ECU 70 increases or decreases the pressure of the brake fluid applied to the wheel cylinders 14, 15, 34, and 35 to avoid skidding of the wheels FR, FL, RL, and RR. Specifically, the brake ECU 70 selectively controls the operations of the first to fourth pressure-increasing valves 17, 18, 37, and 38 or the first to fourth pressure-reducing valves 21, 22, 41, and 42 to increase or decrease the W/C pressure in a target one(s) of the wheel cylinders 14, 15, 34, and 35 into agreement with a target value.

Figure 2:
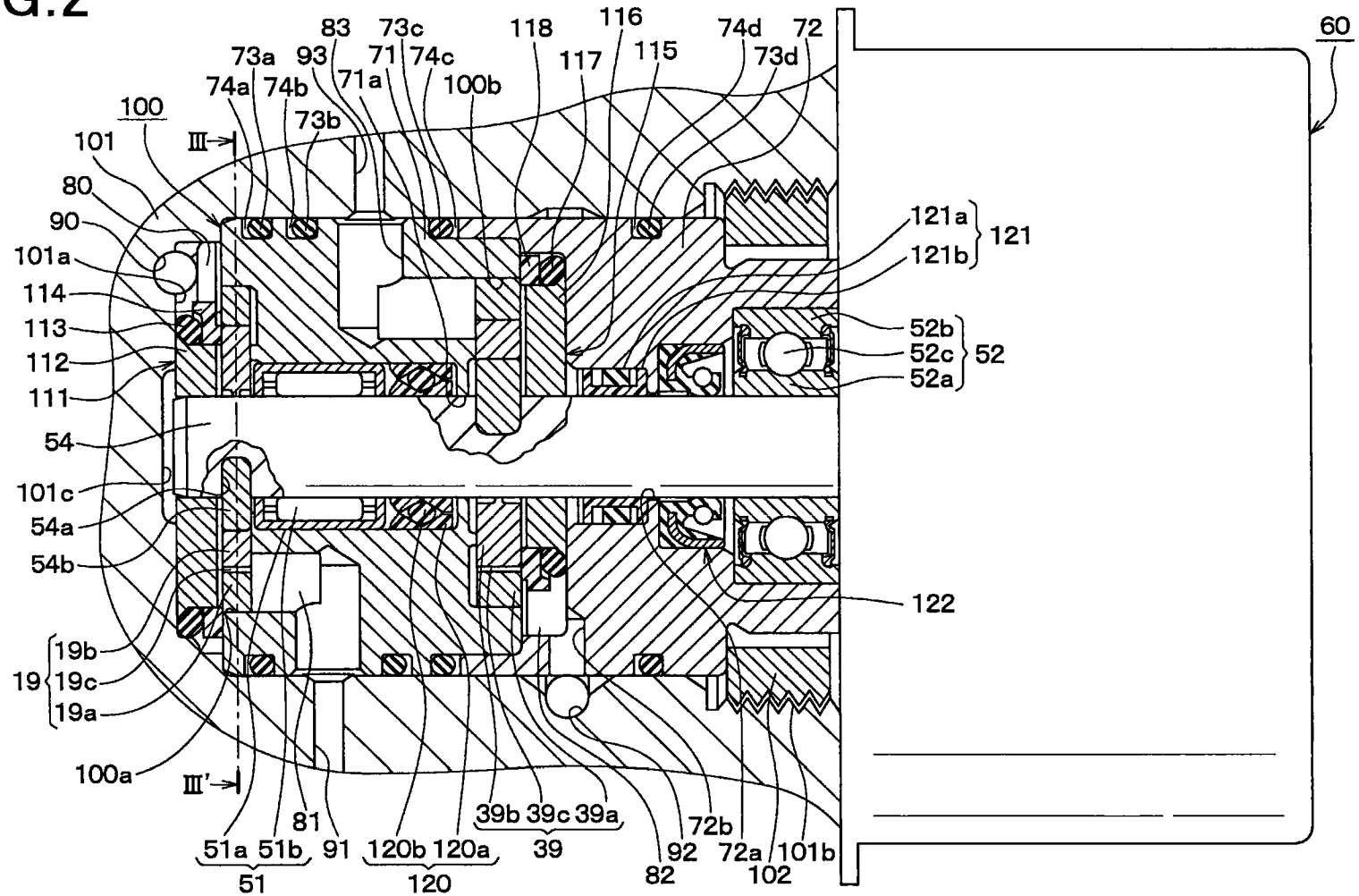
FIG. 2 is a partially sectional view which illustrates a pump body of the gear pump apparatus secured to a housing of an actuator.

The structure of the gear pump apparatus, that is, the structure of the gear pumps 19 and 39 installed in the brake device 1 will be described below with reference to FIG. 2. FIG. 2 is a partially sectional view which illustrates a pump body 100 of the gear pump apparatus secured to a housing 101 of the actuator 50 working to control the pressure of the brake fluid. The vertical direction in the drawing is the vertical direction of the vehicle.

The automotive brake system is, as described above, equipped with two hydraulic systems: the first hydraulic circuit 50*a* and the second hydraulic circuit 50*b* and thus has the pump body 100 made up of the gear pump 19 for the first hydraulic circuit 50*a* and the gear pump 39 for the second hydraulic circuit 50*b*.

The gear pumps 19 and 39 installed in the pump body 100 are driven by rotation of a drive shaft (i.e., an output shaft) 54 of the motor 60. The drive shaft 54 is retained by a first bearing 51 and a second bearing 52. A casing which will also be referred to as a pump casing below and serves as an outer shell or housing of the pump body 100 is made up of an aluminum-made cylinder 71 and an aluminum-made plug 72. The first bearing 51 is disposed in the cylinder 71. The second bearing 52 is disposed in the plug 72.

The cylinder 71 and the plug 72 are placed coaxially. The cylinder 71 has an end portion press-fit in the plug 72 to form a shell or casing of the pump body 100. The pump body 100 is made up of the cylinder 71, the plug 72, the gear pumps 19 and 39, and sealing mechanisms, as will be described later.

The pump body 100 is assembled in the way, as described above, and fitted from the right side of the drawing into a substantially cylindrical mount chamber 101*a* formed in the aluminum-made housing 101 of the actuator 50. The mount chamber 101*a* has an internal thread 101*b* formed in an inner end wall thereof. An annular screw 102 which has an external thread is fastened into engagement with the internal thread 101*b* to retain the pump body 100 in the housing 101 firmly. The screw 102 serves to hold the pump body 100 from being detached from the housing 101.

The direction in which the pump body 100 is fitted into the mount chamber 101*a* of the housing 101 will also be referred to as an insertion direction below. The axial and circumferential directions of the pump 100 (i.e., the drive shaft 54 of the motor 60) will be generally referred to as an axial direction and a circumferential direction below.

The housing 101 also has a cylindrical center chamber 101*c* formed in a central portion of the bottom of the mount chamber 101*a* which is aligned with the drive shaft 54 of the motor 60. In other words, the center chamber 101*c* is located coaxially with the drive shaft 54. The center chamber 101*c* will also be referred to as a second chamber below. The second chamber 101*c* is greater in diameter than the drive shaft 54. The drive shaft 54 has a head disposed inside the second chamber 101*c* and is placed in non-contact with the housing 101.

The cylinder 71 and the plug 72 have formed therein center holes 71*a* and 72*a* into which the drive shaft 54 is inserted. The drive shaft 54 is retained to be rotatable by the first bearing 51 and the second bearing 52 which are mounted in the center hole 71*a* of the cylinder 71 and the center hole 72*a* of the plug 72. The first and second bearings 51 and 52 may be of any structure, but are implemented by a ball bearing in this embodiment.

Specifically, the first second bearing 51 is made of a needle bearing with no inner race and equipped with an outer race 51*a* and needle rollers 51*b*. The drive shaft 54 is fit in a hole of the first bearing 51 to be retained rotatably. The cylinder 71 has a bearing chamber in a front portion of the center hole 71*a*, that is, formed in front of the insertion direction within the center hole 71*a*. The bearing chamber a relatively great diameter. The first bearing 51 is press-fit in the bearing chamber.

The second bearing 52 is made up of an inner race 52*a*, an outer race 52*b*, and rollers (e.g., balls) 52*c*. The outer race 52*b* is press-fit in the center hole 72*a* of the plug 72 to retain the second bearing 52 firmly inside the plug 72. The drive shaft 54 is also fit in the inner race 52*a* to be rotatable.

Figure 3:
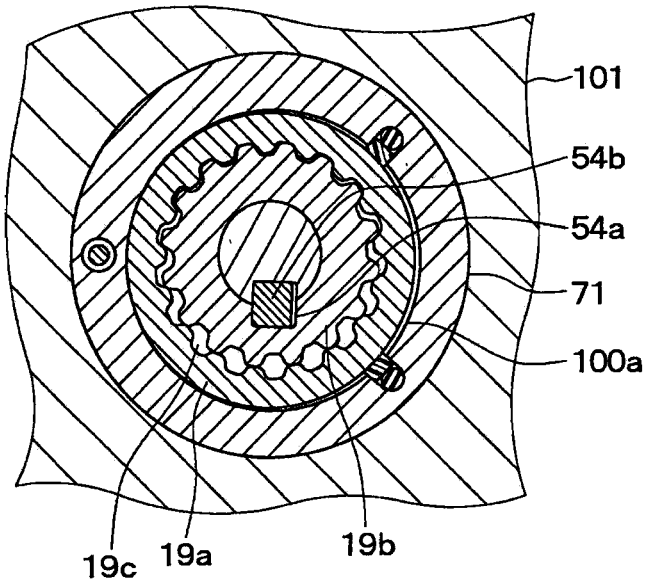
FIG. 3 is a traverse sectional view, as taken along the line III-III in FIG. 2.

The gear pumps 19 and 39 are arranged on both sides of the first bearing 51. Specifically, the gear pump 19 is disposed in front of the first bearing 51 in the insertion direction. The gear pump 39 is disposed between the first and second bearings 51 and 52. The structure of the gear pumps 19 and 39 will be described below with reference to FIG. 3.

The gear pump 19 is mounted within a rotor chamber 100*a* which is defined by a cylindrical counterbore formed in the front end (i.e., the left end, as viewed in the drawing) of the cylinder 71. The gear pump 19 is implemented by an internal gear trochoid pump which is driven by the drive shaft 54 of the motor 60 which extends into the rotor chamber 100*a*.

Specifically, the gear pump 19 is equipped with a rotating assembly made up of an outer rotor 19*a* and an inner rotor 19*b*. The drive shaft 54 is fit in a center hole of the inner rotor 19*b*. A key 54*b* is fit in a hole 54*a* formed in the drive shaft 54 and works to transmit torque of the drive shaft 54 to the inner rotor 19*b*.

The outer rotor 19*a* has inner teeth formed on an inner periphery thereof. The inner rotor 19*b* has outer teeth formed on an outer periphery thereof. The inner teeth of the outer rotor 19*a* mesh with the outer teeth of the inner rotor 19*b* so as to create a plurality of gaps or enclosed cavities 19*c* therebetween. The cavities 19*c* are changed in volume thereof with rotation of the drive shaft 54, thereby sucking or discharging the brake fluid.

The gear pump 39 is, like the gear pump 19, disposed in a rotor chamber 100*b* which is defined by a cylindrical counterbore formed in the rear end (i.e., the right end, as viewed in the drawing) of the cylinder 71. The gear pump 39 is also driven by the drive shaft 54 passing through the rotor chamber 100*b*. The gear pump 39 is implemented by an internal gear pump and, like the gear pump 19, includes a rotating assembly made up of an outer rotor 39*a* and an inner rotor 39*b*. The outer rotor 39*a* has inner teeth formed on an inner periphery thereof. The inner rotor 39*b* has outer teeth formed on an outer periphery thereof. The inner teeth of the outer rotor 39*a* mesh with the outer teeth of the inner rotor 39*b* so as to create a plurality of gaps or enclosed cavities 39*c* therebetween. The cavities 39*c* are changed in volume thereof with rotation of the drive shaft 54, thereby sucking or discharging the brake fluid. The gear pump 39 is located at an angular position which is 180° away from the gear pump 19 around the axis of the drive shaft 54. In other words, the layout of the cavities 39*c* is diametrically opposed to, that is, symmetrical with that of the cavities 19*c* of the gear pump 19 about the axis of the drive shaft 54. This cancels high pressures of the brake fluid against each other which are developed at outlets of the gear pumps 19 and 39 and adversely exerted on the drive shaft 54.

The gear pumps 19 and 39 are substantially identical in structure with each other, but have thicknesses different from each other in the axial direction thereof. Specifically, the gear pump 39 which is mounted in the second hydraulic circuit 50*b* (i.e., the front hydraulic circuit) is greater in thickness than the gear pump 19 which is mounted in the first hydraulic circuit 50*a* (i.e., the rear hydraulic circuit). More specifically, the rotors 39*a* and 39*b* of the gear pump 39 are greater in thickness thereof than the rotors 19*a* and 19*b* of the gear pump 19 in the axial direction thereof. This causes the gear pump 39 to be greater in suction or discharge rate of the brake fluid than the gear pump 19, thus enabling a greater volume of the brake fluid to be delivered to the front hydraulic circuit than to the rear hydraulic circuit.

The housing 101, as clearly illustrated in FIG. 2, has a sealing mechanism 111 installed therein. Specifically, the sealing mechanism 111 is disposed outside the front end of the cylinder 71 (i.e., the gear pump 19) and works to press the gear pump 19 against the cylinder 71. The plug 72 has a sealing mechanism 115 installed behind the cylinder 71, that is, the rear side (i.e., the right side, as viewed in the drawing) of the cylinder 71 (i.e., the gear pump 39). The sealing mechanism 115 works to press the gear pump 39 against the cylinder 71.

The sealing mechanism 111 is of an annular shape and has the top end of the drive shaft 54 fit therein and urges the outer rotor 19*a* and the inner rotor 19*b* of the gear pump 19 against the end of the cylinder 71 to create a hermetical seal or hermetically isolate between a lower-pressure portion and a higher-pressure portion of one of the ends of the gear pump 19. Specifically, the sealing mechanism 111 is placed in contact with the bottom (i.e., an outer shell or outer wall of the housing 101) of the mount chamber 101*a* of the housing 101 and selected portions of the outer rotor 19*a* and the inner rotor 19*b*, thereby developing the hermetical seal.

The sealing mechanism 111 is made up of a hollow frame-like inner member 112, an annular rubber member 113, and a hollow frame-like outer member 114. The inner member 112 is fit in the outer member 114 with the annular rubber member 113 being placed between the outer peripheral wall of the inner member 112 and the inner peripheral wall of the outer member 114.

Figure 4A:
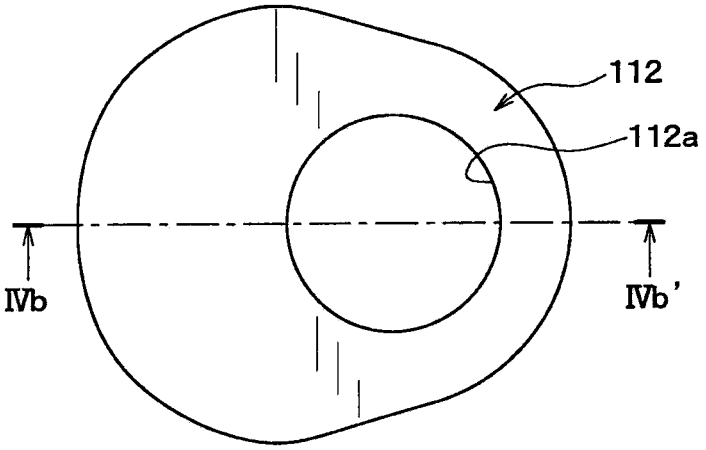
FIG. 4(*a*) is a front view which illustrates an inner member of a sealing mechanism installed in the gear pump apparatus of FIG. 1.
Figure 4B:
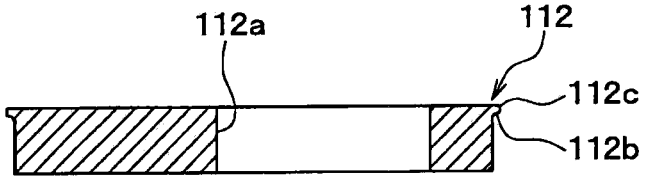
Figure 5A:
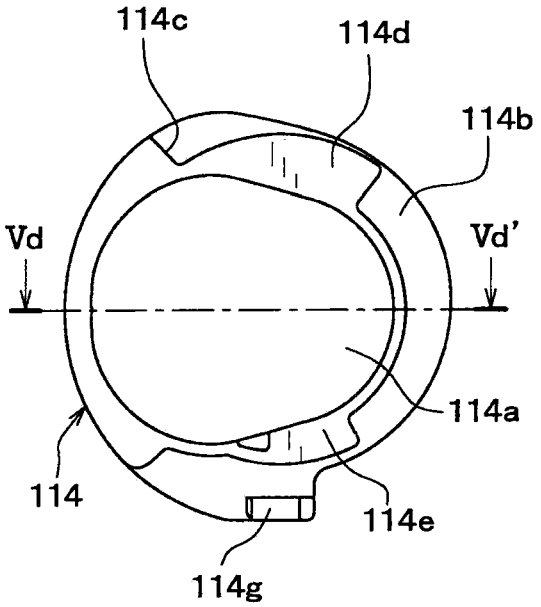
FIG. 5(*a*) is a front view which illustrates an outer member of a sealing mechanism installed in the gear pump apparatus of FIG. 1.
Figure 5B:
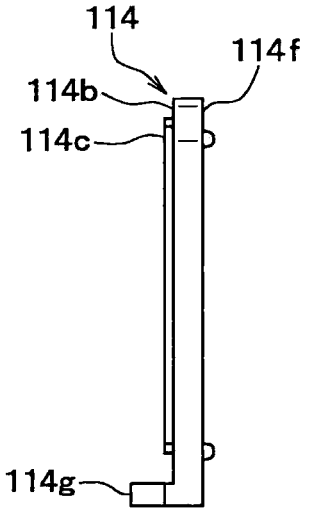
Figure 5C:
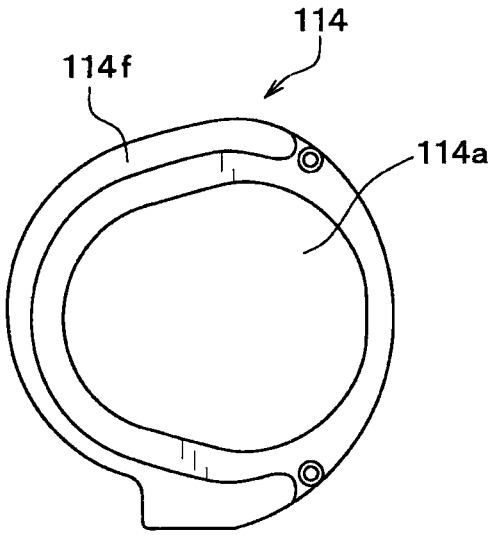
Figure 5D:
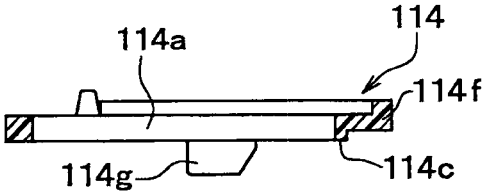

The inner member 112 and the outer member 114 of the sealing mechanism 111 will be described below in detail with reference to FIGS. 4(*a*), 4(*b*), and 5(*a*) to 5(*d*). FIG. 4(*b*) is a sectional view, as taken along the line IVb-IVb' in FIG. 4(*a*), which represents the same cross section as that of the sealing mechanism 111 in FIG. 2.

The inner member 112 is, as can be seen in FIGS. 4(*a*) and 4(*b*), formed by a one-piece member made from a metallic material, such as ferrous, SUS-based, aluminum-based, or copper-based material, which is greater in Young's modulus than the outer member 114.

The inner member 112 is, as described above, of a hollow frame-like shape and has formed therein a hole 112*a* in which the head of the drive shaft 54 is fit. The hole 112*a* is circular and contoured to conform with the outer periphery of the drive shaft 54, but may be shaped to have a plurality of slits extending in the axial direction thereof. The inner member 112 is, as described above, made of metal and thus may be thermally seized due to sliding friction between itself and the drive shaft 54 which is also made of metal. Therefore, in the case where the inner member 112 and the drive shaft 54 are made of materials which may result in thermal seizure therebetween, it is advisable that the inner peripheral surface of the hole 112*a* be treated, for example, coated or plated with an anti-seizing material.

The inner member 112 is, as can be seen from FIG. 4(*a*), oval and includes two curved sections: a smaller curvature section (i.e., the right side, as viewed in the drawing, that is, a high-pressure discharge side of the gear pump 19) and a greater curvature section (i.e., the left side, as viewed in the drawing, that is, a low-pressure intake side of the gear pump 19). The smaller curvature section is smaller in radius of curvature than an inscribed circle passing through all bases (or bottoms) of the cavities 19*c*, in other words, smaller than the outer periphery of the inner rotor 19*b*. The greater curvature section is greater in radius of curvature than a circumscribed circle passing through all vertices of the cavities 19*c*. With this geometry of the inner member 112, when the annular rubber member 113 is fit on the outer periphery of the inner member 112, an area around the drive shaft 54 and the intake side of the gear pump 19 which are lower in pressure level are located inside the annular rubber member 113, while the discharge side of the gear pump 19 which is higher in pressure level is located outside the annular rubber member 113.

When the gear pump 19 is in a pumping operation, the high-pressure of the brake fluid, pumped out of the gear pump 19, will be applied to the annular rubber member 113, so that the annular rubber member 113 is elastically deformed or compressed inwardly in the radial direction thereof against the outer peripheral wall of the inner member 112. The outer peripheral wall of the inner member 112, thus, has a surface (which will also be referred to as a pressure-exerted surface below) on which the pressure is exerted inwardly through the deformation of the annular rubber member 113. The pressure-exerted surface of the inner member 112 is, as can be seen in FIGS. 2 and 4(*b*), shaped to have an annular slant area 112*b* which extends obliquely outward from a major part of the outer periphery of the inner member 112, thereby thrusting the inner member 112 away from the gear pump 19 in the axial direction thereof. Specifically, the inner member 112 has an annular flange 112*c* formed on a front corner farther away from the gear pump 19. The flange 112*c* extends fully in the circumferential direction of the inner member 112 and has the slant area 112*b* facing the gear pump 19.

Figure 6:
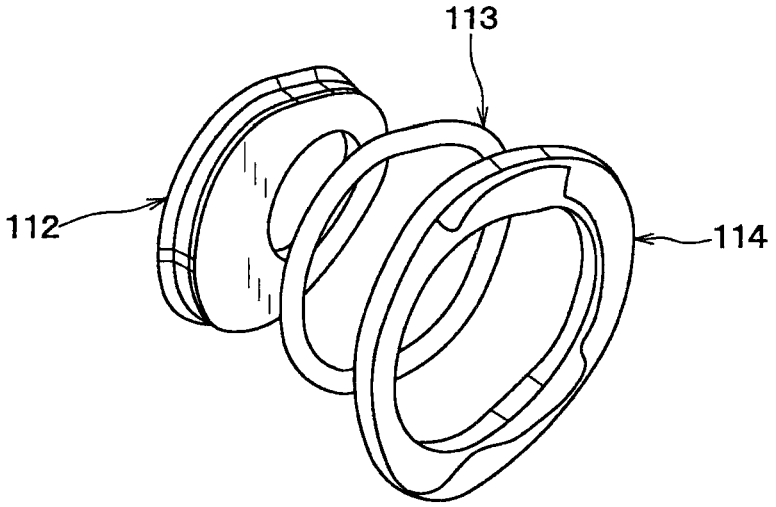
FIG. 6 is an exploded perspective view which illustrates a sealing mechanism installed in the gear pump apparatus of FIG. 1.

The annular rubber member 113 is, as clearly illustrated in FIG. 6, implemented by an O-ring and fit on the outer periphery of the inner member 112. In other words, the annular rubber member 113 is interposed between the inner member 112 and the outer member 114. The annular rubber member 113 functions to increase the pressure, as exerted by the above described compression thereof on the pressure-exerted surface of the inner member 112, with a rise in hydraulic pressure discharged from the gear pump 19 (i.e., the discharge pressure of the gear pump 19) during the pumping operation thereof. The annular rubber member 113 is also placed in contact abutment with the bottom of the mount chamber 101*a* to hermetically seal between the discharge side of the gear pump 19 (i.e., a high-pressure region within the gear pump 19) and a low-pressure region within the gear pump 19 including a peripheral region around the drive shaft 54 and the intake side of the gear pump 19. The annular rubber member 113 may be contoured to conform with the outer periphery of the inner member 112, but may alternatively be shaped to be circular which is permitted to be elastically deformed and fit on the outer periphery of the inner member 112.

The outer member 114 is, as described above, placed on one of the ends of the gear pump 19 and functions to hermetically seal between the lower-pressure side and the higher-pressure side of the gear pump 19. The outer member 114 is made from resin material, such as PEEK (Poly Ether Ether Ketone), which is lower in Young's modulus than the inner member 112. The outer member 114 is, as clearly illustrated in FIGS. 5(*a*), 5(*c*), and 5(*d*), of a hollow frame-like shape and has a center hole 114*a* whose outline is contoured to conform with the outer periphery of the inner member 112. The outer member 114 is formed by an annular plate and has one of opposed ends which is stepwise. Specifically, the outer member 114 has a recess (i.e., a concave portion) 114*b* and a protrusion (i.e., a convex portion) 114*c* formed on one of the ends thereof which faces the gear pump 19. The protrusion 114*c* is placed in contact with end surfaces of both the rotors 19*a* and 19*b*.

The protrusion 114*c* has hermetically-sealing portions 114*d* and 114*e* formed thereon. The hermetically sealing portion 114*d* has a width which is great enough to fully close one of the cavities 19*c* which is located between the inlet port 81 and the discharge chamber 80, as will be described later in detail. Similarly, the hermetically sealing portion 114*e* has a width which is great enough to fully close one of the cavities 19*c* which is diametrically opposed to the one of the cavities 19*c* closed by the hermetically sealing portion 114*d* and located between the inlet port 81 and the discharge chamber 80. This hermetically isolates between the high-pressure region and the low-pressure region within the gear pump 19. The recess 114*b* hydraulically communicates with the discharge chamber 80 and is subjected to the high discharge pressure. Therefore, when the gear pump 19 is discharging the brake fluid at high pressure, it will cause the high pressure of the brake fluid to act on the recess 114*b* and the outer periphery of the outer member 114, thereby resulting in elastic deformation of the outer member 114 to grip the inner member 112 firmly.

The inner member 112 and the annular rubber member 113 are attached to the outer member 114 from the opposite side of the gear pump 19. The outer member 114 has an arc-shaped wall 114*f* formed on one of the end surfaces thereof which is farther away from the gear pump 19. The arc-shaped wall 114*f* is contoured to conform with the configuration of a portion of the annular rubber member 113, thereby ensuring the positioning of the outer member 114, the inner member 112, and the annular rubber member 113 accurately.

The outer member 112 has, as illustrated in FIGS. 5(*a*), 5(*b*), and 5(*d*), a rotation stopper 114*g* formed in the shape of a protrusion on the end surface thereof facing the gear pump 19. The rotation stopper 114*g* is fit in a recess or bore (not shown) formed in the cylinder 71 to stop the outer member 112 from rotating.

The sealing mechanism 111 has a radius that is a distance between the outer periphery thereof and the center of the drive shaft 54 at least in an upper portion of the cross section of the sealing mechanism 111, as viewed in FIG. 2, and smaller than the radius of the mount chamber 101*a* of the housing 101, thereby creating an air gap between the sealing mechanism 111 and the mount chamber 101*a* of the housing 101 through which the brake fluid flows. The air gap defines the discharge chamber 80 which hydraulically connects with an outlet path 90 formed in the bottom of the mount chamber 101*a* of the housing 101. The gear pump 19 works to output the brake fluid through a hydraulic outlet circuit defined by the discharge chamber 80 and the outlet path 90.

The cylinder 71, as illustrated in FIG. 2, has formed therein an inlet port 81 which communicates with one(s) of the cavities 19*c* of the gear pump 19 through which the brake fluid is sucked into the gear pump 19. The inlet port 81 is formed in the end surface of the cylinder 71 which faces the gear pump 19 and extends to the outer circumference of the cylinder 71. The housing 101 has an inlet path 91 formed in the side wall of the mount chamber 101*a*. The inlet port 81 leads to the inlet path 91. The gear pump 19 works to suck the brake fluid through a hydraulic inlet circuit defined by the inlet path 91 and the intake port 81.

The sealing mechanism 115 is made up of a hollow frame-like inner member 116, an annular rubber member 117, and a hollow frame-like outer member 118. The inner member 116 is fit in the outer member 118 with the annular rubber member 117 being placed between the outer peripheral wall of the inner member 116 and the inner peripheral wall of the outer member 118. The sealing mechanism 115 is designed to have a sealing surface facing in an opposite direction to that in which the sealing surface of the sealing mechanism 111 faces. In other words, the configuration of the sealing mechanism 115 is an mirror image of (i.e., symmetrical with) the sealing mechanism 111, but the sealing mechanism 115 is 180° out of phase with the sealing mechanism 111 around the drive shaft 54. Other arrangements are identical with those of the sealing mechanism 111, and explanation thereof in detail will be omitted here.

The sealing mechanism 115 has a radius that is a distance between the outer periphery thereof and the center of the drive shaft 54 in at least a lower portion of the cross section of the sealing mechanism 115, as viewed in FIG. 2, and smaller than a radius of an inner chamber of the plug 72, thereby creating an air gap between the sealing mechanism 115 and the plug 72 through which the brake fluid flows. The air gap defines a discharge chamber 82 which hydraulically connects with a connecting path 72*b* and an outlet path 92. The connecting path 72*b* is formed in the plug 72. The outlet path 92 is formed in the side wall of the mount chamber 101*a* of the housing 101. The gear pump 39 works to discharge the brake fluid through a hydraulic outlet circuit defined by the discharge chamber 82 and the connecting path 72*b*.

The cylinder 71 has opposed end surfaces serving as sealing surfaces which face the gear pumps 19 and 39, respectively. Specifically, each of the gear pumps 19 and 39 is placed in close contact with one of the sealing surfaces of the cylinder 71 to develop a mechanical seal therebetween and also hermetical seal between a lower-pressure region and a higher-pressure region on the end of a corresponding one of the gear pumps 19 and 39 which is far away from the sealing surfaces of the cylinder 71.

The cylinder 71, as illustrated in FIG. 2, has formed therein an inlet port 83 which communicates with one(s) of the cavities 39*c* of the gear pump 39 through which the brake fluid is sucked into the gear pump 39. The inlet port 83 is formed in the end surface of the cylinder 71 which faces the gear pump 39 and extends to the outer circumference of the cylinder 71. The housing 101 has an inlet path 93 formed in the side wall of the mount chamber 101*a*. The inlet port 83 leads to the inlet path 93. The gear pump 39 works to suck the brake fluid through a hydraulic inlet circuit defined by the inlet path 93 and the intake port 83.

The inlet path 91 and the outlet path 90 in FIG. 2 correspond to the hydraulic line C in FIG. 1. The inlet path 93 and the outlet path 92 in FIG. 2 correspond to the hydraulic line G in FIG. 1.

The cylinder 71 also has a sealing member 120 disposed in the center hole 71*a* thereof. The sealing member 120 is located behind the first bearing 51 in the insertion direction, that is, arranged close to the gear pump 39 than the first bearing 51 is. The sealing member 120 is made up of an annular resinous member 120*a* and an annular rubber member 120*b*. The annular resinous member 120*a* is of a U-shape in transverse section thereof. The annular rubber member 120*b* is fit within the annular resinous member 120*a*. The sealing member 120 is designed to have the annular resinous member 120*a* elastically compressed by the cylinder 71 and the drive shaft 54 to press the annular rubber member 120*b*, thereby creating a resultant reactive force to bring the annular resinous member 120*b* into abutment with the cylinder 71 and the drive shaft 54 to develop a hermetical seal therebetween. This hermetically isolates between two hydraulic flow paths: one for the gear pump 19 and the other for the gear pump 39 within the center hole 71*a* of the cylinder 71.

The plug 72 has three chambers defined within the center hole 72*a*. The three chambers are disposed adjacent each other and different in inner diameter from each other. The right one of the chambers, as viewed in FIG. 2 which will also be referred to as a first chamber below, is a chamber in which a sealing member 121 is disposed in the shape of a ring. The sealing member 121 is made up of an elastic ring 121*a* made of, for example, rubber and a resinous ring 121*b*. The resinous ring 121*b* has formed therein a groove which has a depth extending in a radial direction of the resinous ring 121*b*. The elastic ring 121*a* is fit in the groove of the resinous ring 121*b*. The elastic ring 121*a* elastically presses the resinous ring 121*b* into contact abutment with the periphery of the drive shaft 54.

A middle one of the chambers in the center hole 72*a* of the plug 72 located adjacent the sealing member 121, which will also be referred to as a second chamber below, is a chamber in which the sealing mechanism 115 is disposed. The connecting path 72*b* extends from the second chamber to the outer circumferential surface of the plug 72. The leftmost one of the chambers in the center hole 72*a*, which will also be referred to as a third chamber below, is a chamber in which a rear end portion (i.e., a right end portion, as viewed in the drawing) of the cylinder 71 is press-fit. The rear end portion of the cylinder 71 fit in the center hole 72*a* of the plug 71 is a small-diameter portion which is smaller in diameter than another major portion of the cylinder 71. The small-diameter portion of the cylinder 71 has a dimension (i.e., a length) in the axial direction of the cylinder 71 which is greater than that (i.e., a depth) of the third chamber in the axial direction of the plug 72, thereby creating an annular groove 74*c* between the front end of the plug 72 and the cylinder 71 (i.e., the shoulder between the small-diameter portion and the major portion of the cylinder 71) when the cylinder 71 is fit in the center hole 72*a* of the plug 72.

The plug 72 also has a fourth chamber defined in a rear portion (i.e., a right portion, as viewed in FIG. 2) of the center hole 72*a*. The fourth chamber is a chamber in which an oil seal 122 (i.e., a sealing member) is disposed. The oil seal 122 is fit on the drive shaft 54 and located closer to the motor 60 than the sealing member 121 is, that is, on the opposite side of the sealing member 121 to the gear pump 39. The sealing member 121, thus, works to avoid the leakage of the brake fluid from the center hole 72*a* outside the pump body 100. Additionally, the oil seal 122 blocks a possible leakage of the brake fluid through the sealing member 121. In other words, the sealing member 121 and the oil seal 122 function as a double sealing mechanism.

O-rings 73*a*, 73*b*, 73*c*, and 73*d* are each fit in the shape of an annular seal on the outer periphery of the pump housing 100. The O-rings 73*a* to 73*d* serve to hermetically block the leakage of the brake fluid between the above described two hydraulic flow paths: one for the gear pump 19 and the other for the gear pump 39 within the housing 101 and between an inlet and an outlet of each of the two hydraulic paths. Specifically, the O-ring 73*a* is disposed between a hydraulic path extending through the discharge chamber 80 and the outlet path 91 and a hydraulic path extending through the inlet port 81 and the inlet path 91. The O-ring 73*b* is disposed between a hydraulic path extending through the inlet port 81 and the inlet path 91 and a hydraulic path extending through the inlet port 83 and the inlet path 93. The O-ring 73*c* is disposed between a hydraulic path extending through the hydraulic path extending through the inlet port 83 and the inlet path 93 and a hydraulic line extending through the discharge chamber 82 and the outlet path 92. The O-ring 73*d* is disposed between the hydraulic line extending through the discharge chamber 82 and the outlet path 92 and outside the housing 101. Each of the O-rings 73*a* to 73*d* is of an enclosed circular shape extending around the drive shaft 54 of the motor 60. The O-rings 73*a*, 73*c*, and 73*d* are arranged at substantially an equal interval away from each other in the axial direction of the pump body 100, while the O-ring 73*d* is disposed between the O-ring 73*a* and the O-ring 73*c*, thus permitting the axial length of the cylinder 71 (i.e., an overall axial length of the pump body 100) to be decreased.

The pump body 100 has formed in the outer periphery thereof grooves 74*a*, 74*b*, 74*c*, and 74*d* in the O-rings 73*a* to 73*d* are fit. Specifically, the grooves 74*a* and 74*b* are defined by annular recesses formed in the outer periphery of the cylinder 71. The groove 74*c* is defined by the shoulder formed on the front end of the above described small-diameter portion of the cylinder 71 and the front end of the plug 74. The groove 74*d* is defined by a recess formed in the outer periphery of the plug 72. The assembling of the pump body 100 and the housing 101 is achieved by inserting the pump body 100 with the O-rings 73*a* to 74*d* fit in the grooves 74*a* to 74*d* into the mount chamber 101*a* of the housing 101, thereby elastically compressing the O-rings 73*a* to 73*d* against the inner peripheral wall of the housing 101 to create hermetical seals.

The plug 72, as clearly illustrated in FIG. 2, has a large-diameter portion, a small-diameter portion, and a shoulder between the large-diameter portion and the small-diameter portion. The small-diameter portion is located closer to the opening of the mount chamber 101*a* (i.e., the motor 60) than the large-diameter portion is. The annular screw 102 (i.e., a retainer) is fit on the small-diameter portion of the plug 72 in abutment with the shoulder in thread engagement with the housing 101, thereby retaining the pump body 100 in the housing 101 firmly.

The pumping operation of the gear pump apparatus (i.e., the gear pumps 19 and 39) is achieved by rotation of the drive shaft 54 of the motor 60 to suck or discharge the brake fluid, thereby performing the anti-skid brake control mode or the motion control mode in the automotive brake system.

In the pumping operation of the gear pump apparatus, the discharge pressures, as produced by the gear pumps 19 and 39, are applied to the discharge chambers 80 and 82, respectively. This will cause the high pressure to be exerted on the end surfaces of the outer members 114 and 118 of the sealing mechanisms 111 and 115 which are farther away from the gear pumps 19 and 39, respectively, thereby pressing the outer members 114 and 118 against the cylinder 71 to bring the sealing surfaces of the outer members 114 and 118 (e.g., the end surface of the protrusion 114*c* of the first sealing mechanism 111) into constant abutment with the gear pumps 19 and 39. This creates hermetical seals on the end surfaces of the gear pumps 19 and 39 which face the sealing mechanisms 111 and 115 and also creates, as described above, the mechanical seals on the other end surfaces of the gear pumps 19 and 39.

Figure 7:
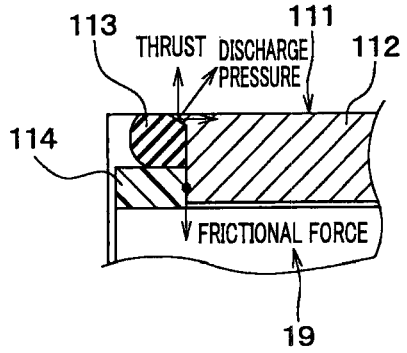
FIG. 7 is a schematic sectional view which represents components of pressure acting on a surface of an inner member of a sealing mechanism.

When the discharge pressures, as produced by the gear pumps 19 and 39, are applied to the discharge chambers 80 and 82, it will cause the annular rubber members 113 and 117 to press, as described above, the pressure-exerted surfaces of the inner members 112 and 116 of the sealing mechanisms 111 and 115 in a direction perpendicular thereto. FIG. 7 is a schematic sectional view which illustrates, as an example, components of elastic pressure exerted by the annular rubber member 113 on the inner member 112. Specifically, the elastic pressure, as created by the annular rubber member 113, acts on the pressure-exerted surface of the inner member 112 substantially in the direction perpendicular thereto. This causes a component of the elastic pressure to develop, as can be seen in FIG. 7, thrust to push the inner member 112 away from the gear pump 19, thereby pressing the inner member 112 against the bottom surface of the mount chamber 101*a* to eliminate an air gap between the inner member 112 and the bottom surface of the mount chamber 101*a*. The same is true of the inner member 116 of the sealing mechanism 115. Specifically, the elastic pressure, as created by the annular rubber member 117, acts on the pressure-exerted surface of the inner member 116 substantially in the direction perpendicular thereto. This causes a component of the elastic pressure to develop, like the sealing mechanism 111, thrust to push the inner member 116 away from the gear pump 39, thereby pressing the inner member 116 against the end surface of the plug 74 to eliminate an air gap between the inner member 116 and the end surface of the plug 74.

The annular rubber members 113 and 117 are also pressed by the high discharge pressure of the gear pumps 19 and 39 against the bottom surface of the mount chamber 101*a* and the end surface of the plug 72. A combination of the annular rubber member 113 and the inner member 112, thus, produces a hermetical seal between inside (i.e., a lower-pressure region) and outside (i.e., a higher-pressure region) the annular rubber member 113. Similarly, a combination of the annular rubber member 117 and the inner member 116 produces a hermetical seal between inside (i.e., a lower-pressure region) and outside (i.e., a higher-pressure region) the annular rubber member 117.

In the above way, the inner members 112 and 116 are pressed into contact abutment with the bottom surface of the mount chamber 101*a* and the end surface of the plug 72, thus eliminating air gaps therebetween and also hermetically isolating the high-pressure regions from the low-pressure regions within the housing 101, respectively. This eliminates the undesirable leakage of hydraulic pressure within the housing 101 and minimizes the deterioration of durability of the annular rubber members 113 and 117 expected to arise from elastic deformation thereof into the air gaps. The annular rubber member 113 is responsive to a rise or a drop in discharge pressure of the gear pump 19 to increase or decrease the pressure acting on the pressure-exerted surface of the inner member 112, thereby minimizing the loss of torque required for the pumping operation of the gear pump 19. The same applies to the gear pump 39.

The pressure-exerted surface of the inner member 112 of the sealing mechanism 111, as described above, includes the slant surface 112*b*. The slant surface 112*b* works to convert the discharge pressure which is produced by the gear pump 19 and acts, as described with reference to FIG. 7, on the slant surface 112*b* in the direction perpendicular thereto into a vector component to thrust the inner member 112 away from the gear pump 19, thereby enhancing the elimination of the air gap between the bottom surface of the mount chamber 101*a* and the inner member 112. The same is true of the inner member 116 of the sealing mechanism 115 for the gear pump 39.

The angle which the slant area 112*b* of the flange 112*c* of the inner member 112 makes with the top end surface (i.e., the left end surface, as viewed in FIG. 2) of the inner member 112 (i.e., a line perpendicular to the center axis of the inner member 112) is optional, but is selected to meet a condition, as discussed below, in this embodiment. When the gear pump 19 is discharging the brake fluid at high pressure, it will cause, as described already, the outer member 114 to be deformed elastically to grip or hold the inner member 112 firmly, which develops friction, as illustrated in FIG. 7, between the inner member 112 and the outer member 114. The angle of inclination of the slant area 112*b* to the top end surface of the inner member 112 is so selected as to produce a degree of thrust to move the inner member 112 away from the gear pump 19 which is great enough to overcome the friction between the inner member 112 and the outer member 114. We have found that when the angle which the slant area 112*b* of the flange 112*c* makes with the top end surface of the inner member 112 which is placed in direct contact with the inner wall of the mount chamber 101*a* is 60°, the above condition is met. The same is true of the slant area of the inner member 116 of the gear pump 39.

The annular rubber members 113 and 117 are in direct contact with the outer members 114 and 118, respectively, when the discharge pressure is applied to the discharge chambers 80 and 82, but need not be so. The degree with which the inner members 112 and 116 are gripped firmly by the outer members 114 and 118 usually increases with a rise in discharge pressure of the gear pumps 19 and 39, thereby avoiding the leakage of the discharge pressure from between each of the annular rubber members 113 and 117 and one of the outer members 114 and 118 even if the annular rubber members 113 and 117 are not in contact with the outer members 114 and 118 when the discharge pressure is applied to the discharge chambers 80 and 82. The direct contact of the annular rubber members 113 and 117 with the outer members 114 and 118 are, however, effective in minimizing the leakage of the discharge pressure from between each of the annular rubber members 113 and 117 and one of the outer members 114 and 118.

The rise in discharge pressure from the gear pumps 19 and 39, as described above, results in an increase in pressure which presses the outer members 114 and 118 against the gear pumps 19 and 39, respectively, thus leading to an increase in loss of torque required for the pumping operation of the gear pumps 19 and 39.

In order to alleviate the above problem, the inner members 112 and 116 are made of material which is greater in Young's modulus than the outer members 114 and 118, thereby resulting in a decrease in degree of pressure by which the outer members 114 and 118 are thrust against the gear pumps 19 and 39, respectively, and also resulting in a decrease in loss of torque required for the pumping operation of the gear pumps 19 and 39. This will also be discussed below with reference to FIGS. 8 and 9, taking, as an example, the sealing mechanism 111 of the gear pump 19. The same is true of the sealing mechanism 115 of the gear pump 39.

The outer member 114 is, as described already, elastically deformed when subjected to the discharge pressure of the pump 19, thereby gripping the inner member 112. If the pressure, as exerted by the outer member 114 on the inner member 112, is expressed as gripping force Fin FIG. 8, the force of friction between the outer member 114 and the inner member 112 against the movement of the outer member 114 to the gear pump 19 will be a function of the gripping force F.

The above force of friction serves as braking force against the movement of the outer member 114 toward the gear pump 19. If a coefficient of friction between the outer member 114 and the inner member 112 is expressed as a friction coefficient μ, a relation of braking force=friction coefficient μ is met. Specifically, the outer member 114 is pressed by pressing force F1, as produced by the discharge pressure, against the gear pump 19, so that the braking force Fμ acts in an opposite direction to the gripping force F1, that is, serves to absorb or attenuate the gripping force F1. An increase in the gripping force F, therefore, results in an increase in the braking force Fμ, which will lead to a decrease in the pressing force F1. It is, thus, advisable that the inner member 112 and the outer member 114 be made from materials which result in an increased value of the friction coefficient μ between portions of the inner member 112 and the outer member 114 which are in direct contact with each other.

The gripping force F will increase with an increase in Young's modules of the inner member 112. This is because a decrease in Young's modulus of the inner member 112 causes the inner member 112 to be deformed and moved away from the outer member 114 when the outer member 114 grips the inner member 112, thus resulting in a decrease in area of contact between the inner member 112 and the outer member 114 needed to ensure a desired value of the gripping force F.

In order to eliminate the above drawback, the inner member 112 is, as described above, made from material which is higher in Young's modulus than the outer member 114 to decrease the degree of deformation of the inner member 112 when being gripped firmly by the outer member 114. This ensures an area of contact between the outer member 114 and the inner member 112 when being gripped by the outer member 114 which is required to increase the gripping force F to enhance the braking force Fμ. This results in a decrease in the pressing force F1, as exerted by the outer member 114 on the gear pump 19, to reduce the loss of the pumping torque of the gear pump 19.

The inner member 112 may be made of metal in order to increase the friction coefficient μ between the inner member 112 and the outer member 114, thereby increasing the braking force Fμ to reduce the loss of the pumping torque of the gear pump 19.

Figure 8:
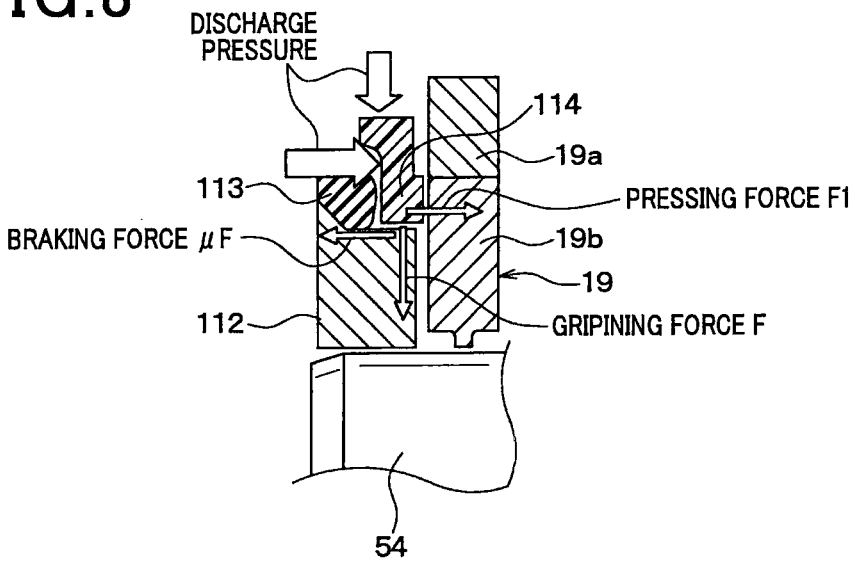
FIG. 8 is a partial sectional view which illustrates forces acting on an outer member of a sealing mechanism when subjected to discharge pressure of a gear pump.
Figure 9:
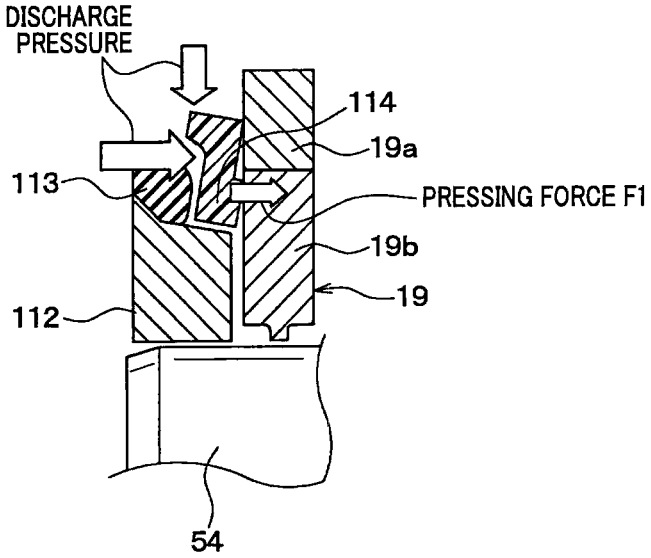
FIG. 9 is a partial sectional view which illustrates tiling of an outer member of a sealing mechanism when subjected to discharge pressure of a gear pump.

The inner member 112 is designed to have a portion which is gripped directly by the outer member 114 and located, as can be seen in FIG. 8, close to the gear pump 19. Therefore, when the Young's modulus of the inner member 112 is selected to be smaller than that of the outer member 114, it will cause, as illustrate in FIG. 9, the outer member 114 to be inclined following the elastic deformation of the inner member 112, thereby causing the degree of pressure exerted by the outer member 114 on the gear pump 19 to be maximized near the outer periphery of the outer member 114. In other words, the distance between the portion of the gear pump 19 pressed by the outer member 114 and the center of rotation of the gear pump 19 becomes longer, thus resulting in an increase in resistance to the rotation of the gear pump 19.

In order to alleviate the above problem, the inner member 112 is made from material whose Young's modulus is greater than that of the outer member 114, thus resulting in a decrease in elastic deformation of the inner member 112 which will lead to the inclination of the outer member 114. This minimizes the distance between the portion of the gear pump 19 pressed by the outer member 114 and the center of rotation of the gear pump 19, thus avoiding an undesirable increase in resistance to the pumping torque of the gear pump 19 and decreasing the loss of pumping torque of the gear pump 19.

A decrease in temperature of the brake fluid usually results in an increase in degree of viscosity thereof, which leads to an increase in torque required for the pumping operation of the gear pump 19. In order to alleviate this problem, the inner members 112 and 116 made of metal to have a coefficient of linear expansion smaller than that of the outer members 114 and 118, thereby increasing the gripping force F for decreasing torque required for the pumping operation of the gear pumps 19 and 39.

Second Embodiment

Figure 10:
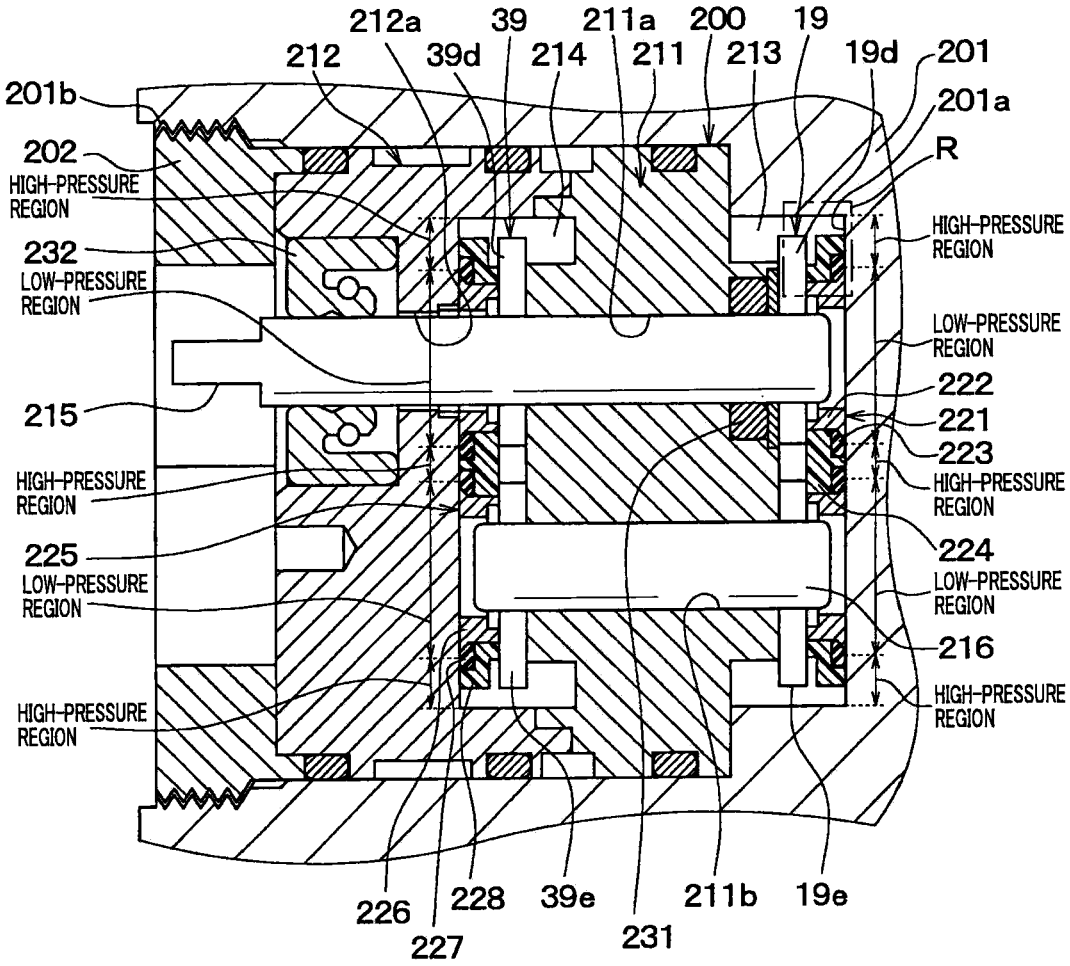
FIG. 10 is a longitudinal sectional view which illustrates a gear pump apparatus according to the second embodiment.

The gear pump apparatus of the first embodiment is equipped with the gear pumps 19 and 39 each implemented by an internal gear pump, but the gear pump apparatus of the second embodiment has the gear pumps 19 and 39 each designed as an external gear pump. FIG. 10 is a partially longitudinal sectional view which illustrates an internal structure of the gear pump apparatus of the second embodiment.

The gear pump apparatus is equipped with a pump body 200 in which the gear pumps 19 and 39 are mounted. The pump body 200 is disposed in a mount chamber 201*a* formed in a housing 201. The joint of the pump body 200 to the housing 201 is achieved by fastening an annular external thread 202 into engagement with an internal thread 201*b* formed in an open end portion (i.e., a left portion, as viewed in FIG. 10) of the housing 201.

Within the mount chamber 201*a*, the gear pump 19 is located closer to the bottom (i.e., the right side, as viewed in FIG. 10) of the mount chamber 201*a* than the gear pump 39 is. The cylinder 211 is interposed between the gear pumps 19 and 39. The plug 212 is arranged in the opposite side of the gear pump 39 to the cylinder 211, in other words, it is located closer to the opening of the housing 201 than the gear pump 39 is. The housing 201 also has a cylindrical gear pump mount chamber in which the gear pump 19 is mounted and which forms the bottom of the mount chamber 201*a*. The bottom of the cylinder 211 is disposed in the gear pump mount chamber of the housing 201 to define a pump chamber 213 between itself and the inner wall of the gear pump mount chamber. The plug 212 has formed in the end thereof a cylindrical gear pump mount chamber which faces the cylinder 211 and in which the gear pump 39 is installed. The gear pump mount chamber of the plug 212 defines a pump chamber 214 between itself and the end of the cylinder 211.

The cylinder 211 and the plug 212 have shaft holes 211*a* and 212*a* extending coaxially with each other through thickness thereof. The drive shaft 215 extends through the shaft holes 211*a* and 212*a*. The drive shaft 215 is joined to the motor 60, as illustrated in FIG. 1. The gear pump 19 has a drive gear 19*d* fit on a portion of the drive shaft 215 between the cylinder 211 and the bottom of the mount chamber 201*a*. Similarly, the gear pump 39 has a drive gear 39*d* fit on a portion of the drive shaft 215 between the cylinder 211 and the plug 212. The cylinder 211 also has a shaft hole 211*b* extending through the thickness thereof. The shaft hole 211*b* is located at a given interval away from the shaft hole 211*a* in the radial direction of the cylinder 211. The cylinder 211 also has retained therein a driven shaft 216 passing through the shaft hole 211*b*. The gear pump 19 has a driven gear 19*e* fit on one of ends of the driven shaft 216 which is closer to the bottom of the mount chamber 201*a*. Similarly, the gear pump 39 has a driven gear 39*e* fit on the other end of the driven shaft 216.

The gear pump apparatus also includes sealing mechanisms 221 and 225. The sealing mechanism 221 is disposed between the gear pump 19 and the bottom of the mount chamber 201*a*. The sealing mechanism is disposed between the gear pump 39 and the plug 212.

In operation, when the drive gears 19*a* and 39*d* of the gear pumps 19 and 39 are rotated by the motor 60 through the drive shaft 215, the driven gears 19*e* and 39*e* are rotated about the driven shaft 216 through engagement with the drive gears 19*a* and 39*d*, thereby causing the brake fluid to be sucked into an intake chamber and discharged from a discharge chamber in each of the gear pumps 19 and 39. The intake chamber and the discharge chamber of the gear pump 19 are defined by the drive gear 19*d*, the driven gear 19*e*, and the inner wall of the pump chamber 213, respectively. Similarly, the intake chamber and the discharge chamber of the gear pump 39 are defined by the drive gear 39*d*, the driven gear 39*e*, and the inner wall of the pump chamber 214, respectively.

The cylinder 211 also has a sealing member 231 disposed in the shaft hole 211*a*. The plug 212 has a chamber formed in the end thereof which is opposed to the end on which the gear pump 39 is installed and also has a sealing member 232 disposed in that chamber. The sealing members 231 and 232 work to seal between the gear pumps 19 and 39 and hermetically isolate the gear pumps 19 and 39 from outside them.

In the thus constructed gear pump apparatus equipped with the gear pumps 19 and 39 each made of the external gear pump, each of the sealing mechanisms 221 and 225 works to press the end of a corresponding one of the gear pumps 19 and 39 to develop a hermetical seal between the intake side and the discharge side thereof. The sealing mechanisms 221 and 225 may be designed to have the same structure as the sealing mechanisms 111 and 115 in the first embodiment.

The structure of the sealing mechanisms 221 and 225 will also be described below in detail with reference to FIGS. 10, 11, and 12.

Figure 11:
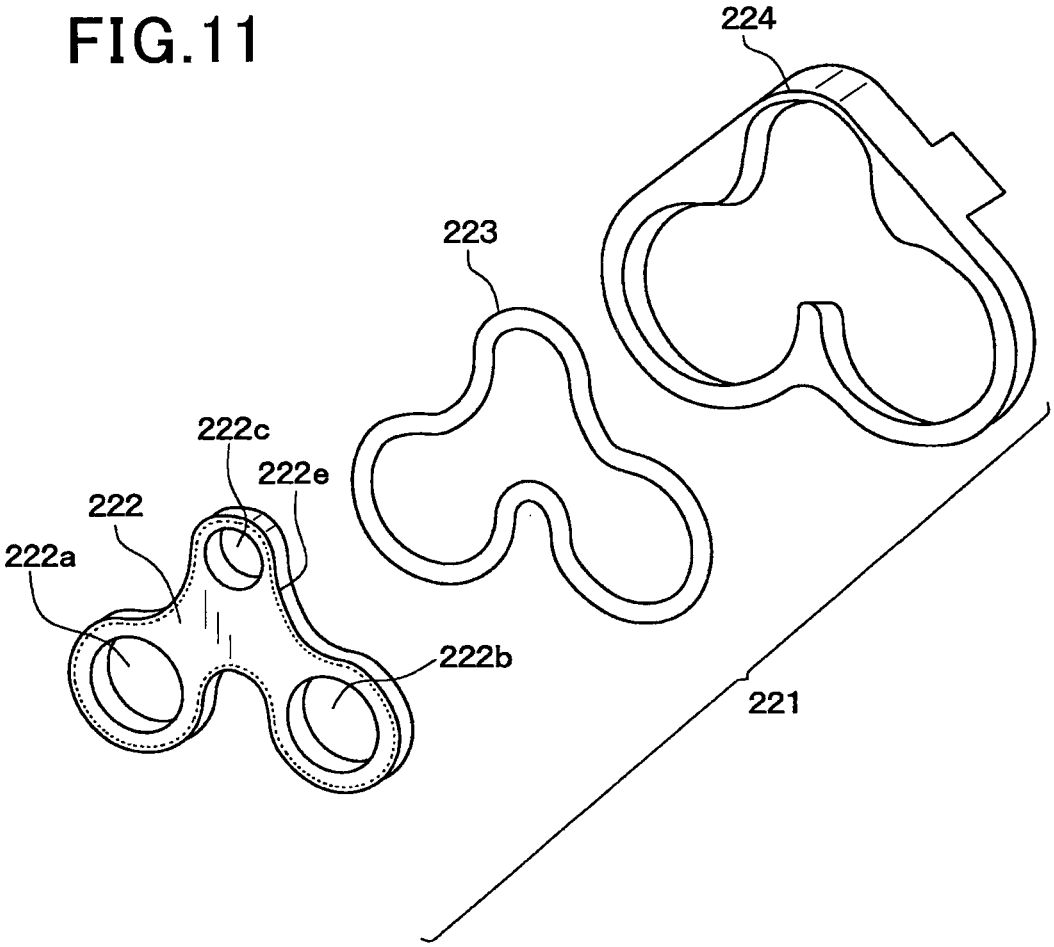
FIG. 11 is an exploded perspective view which illustrates a sealing mechanism installed in the gear pump apparatus of FIG. 10.
Figure 12:
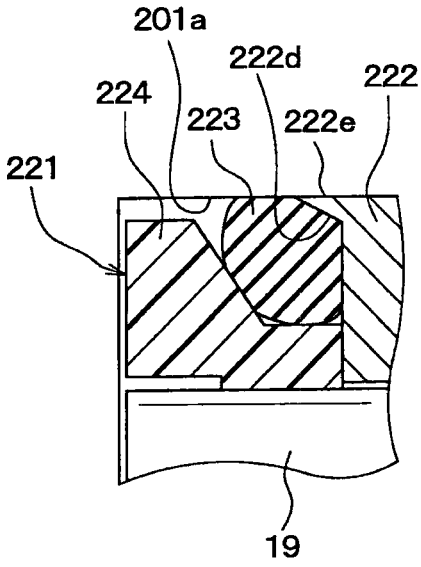
FIG. 12 is an enlarged sectional view of a portion of a sealing mechanism, as enclosed by a broken line R in FIG. 10.

The sealing mechanism 221 is, as illustrated in FIG. 11, equipped with an inner member 222, an elastic rubber member 223, and an outer member 224. The elastic rubber member 223 is, as can be seen in FIG. 11, of a substantially annular shape. The sealing mechanism 221 is of a substantially triangular shape in correspondence to the cylinder 211.

The inner member 222 is formed by a one-piece member made from a metallic material, such as ferrous, SUS-based, aluminum-based, or copper-based material, which is greater in Young's modulus than the outer member 224. The inner member 222 surrounds the drive shaft 215 and the driven shaft 216 and hermetically seal among an intake side of the gear pump 19, peripheries of the shafts 215 and 216, and a discharge side of the gear pump 19 with aid of the annular rubber member 223. Specifically, the inner member 222 has openings 222*a* and 222*b* formed in alignment with the shaft holes 221*a* and 221*b* of the cylinder 211. The inner member 222 also has an inlet 222*c* formed to have the center located on a line perpendicular to a segment passing through the centers of the openings 222*a* and 222*b*. The inlet 222*c* communicates with the intake chamber of the gear pump 19. In the pumping operation of the gear pump 19, the brake fluid is sucked into the intake chamber of the gear pump 19 through the inlet 222*c*. The inner member 222 is made up of a combination of three circular frames which are connected together to define the openings 222*a* and 222*b* and the inlet 222*c* and has a substantially triangular shape as a whole.

When the gear pump 19 is in the pumping operation, the high discharge pressure is exerted on the annular rubber member 223 so that the annular rubber member 223 is pressed inwardly in the radial direction thereof. The outer peripheral wall of the inner member 222, thus, has a surface on which the pressure is exerted inwardly through the annular rubber member 223. Such a pressure-exerted surface of the inner member 222 is geometrically shaped to produce thrust to move the inner member 222 away from the gear pump 19 in the axial direction of the inner member 222. The pressure-exerted surface is, as clearly illustrated in FIG. 12, defined at least by a slant surface 222*d* expanding outwardly from a major part of the inner member 222. Specifically, the inner member 222 has an annular flange 222*e* formed on a corner of an outer peripheral wall thereof which is farther away from the gear pump 19. The flange 222*e* extends fully in the circumferential direction of the inner member 222 and has the slant surface 222*d* facing the gear pump 19.

The annular rubber member 223 is implemented by an O-ring and fit on the outer periphery of the inner member 222. In other words, the annular rubber member 223 is interposed between the inner member 222 and the outer member 224. The annular rubber member 223 functions to increase the pressure acting on the above described pressure-exerted surface of the inner member 222 with a rise in hydraulic pressure discharged from the gear pump 19 during the pumping operation thereof. The annular rubber member 223 is also placed in contact abutment with the bottom of the mount chamber 201*a* to hermetically seal between the discharge side of the gear pump 19 (i.e., the high-pressure region within the gear pump 19) and a region (i.e., the low-pressure region within the pump 19) including peripheral regions of the shafts 215 and 216 and the intake side of the gear pump 19. The annular rubber member 223 may be contoured to conform with the outer periphery of the inner member 222, but may alternatively be shaped to be circular which is permitted to be elastically deformed and fit on the outer periphery of the inner member 222.

The outer member 224 is made from resin material, such as PEEK (Poly Ether Ether Ketone), which is lower in Young's modulus than the inner member 222. The outer member 224 is placed on the end of the gear pump 19 and functions to hermetically seal between the lower-pressure side and the higher-pressure side of the gear pump 19. The outer member 224 is of a substantially hollow triangular shape in correspondence to the outer shape of the inner member 222. The outer member 224 has a sealing surface defined by the end thereof facing the gear pump 19. The sealing surface of the outer member 224 is placed in contact with end surfaces of both the rotors (i.e., gears) 19*d* and 19*e* to create hermetical seals therebetween.

The sealing mechanism 221 is, as described above, placed in direct contact with the end surface of the gear pump 19 to create a hermetical seal between the high-pressure side (i.e., the discharge side) and the low-pressure side (i.e., the intake side) thereof and also in direct contact with the bottom of the mount chamber 201*a* to develop a hermetical seal between the high-pressure side and the low-pressure side.

The sealing mechanism 225 is, like the sealing mechanism 221, made up of an inner member 226, an annular rubber member 227, and an outer member 228. The sealing mechanism 225 is of a substantially triangular shape in correspondence to the cylinder 211. The sealing mechanism 225 is designed to have a sealing surface facing in an opposite direction to that in which the sealing surface of the sealing mechanism 221 faces. In other words, the configuration of the sealing mechanism 225 is symmetrical with that of the sealing mechanism 221. Other arrangements are identical with those of the sealing mechanism 221, and explanation thereof in detail will be omitted here.

In the pumping operation of the gear pump 19, the high-pressure (i.e., the discharge pressure) is produced in the discharge chamber thereof. This develops the low-pressure region which includes peripheral regions of the shaft 215 and 216 and the intake side of the gear pump 19 and the high-pressure region including the discharge side of the gear pump 19. The same is true of the gear pump 39. The discharge pressure (i.e., the high pressure) is, as illustrated in FIG. 10, exerted on outer peripheries of the annular rubber members 223 and 227 of the sealing mechanisms 221 and 225, while the low pressure is exerted on inner peripheries of the annular rubber members 223 and 227. The outer peripheries of the annular rubber members 223 and 227 define the high-pressure regions of the gear pumps 19 and 39, while the inner peripheries of the annular rubber members 223 and 227 define the low-pressure regions of the gear pumps 19 and 39, respectively.

The annular rubber members 223 and 227 elastically press the pressure-exerted surfaces of the inner members 222 and 226 in directions perpendicular thereto with aid of the discharge pressure. Specifically, the pressure-exerted surface of the inner member 222 is pressed in the direction perpendicular thereto to develop thrust to move the inner member 222 away from the gear pump 19, thereby bringing the inner member 222 into constant abutment with the bottom of the mount chamber 201*a* to eliminate an air gap therebetween. The pressure-exerted surface of the inner member 226 of the sealing mechanism 225 is, like the sealing mechanism 221, pressed in the direction perpendicular thereto to develop thrust to move the inner member 226 away from the gear pump 39, thereby bringing the inner member 226 into constant abutment with the end surface of the plug 212 to eliminate an air gap therebetween.

The annular rubber members 223 and 227 are also pressed by the high discharge pressure of the gear pumps 19 and 39 against the bottom surface of the mount chamber 201*a* and the end surface of the plug 212. A combination of the annular rubber member 223 and the inner member 222, thus, produces a hermetical seal between inside (i.e., the lower-pressure region) and outside (i.e., the higher-pressure region) the annular rubber member 223. Similarly, a combination of the annular rubber member 227 and the inner member 226 produces a hermetical seal between inside (i.e., the lower-pressure region) and outside (i.e., the higher-pressure region) the annular rubber member 227.

In the above way, the inner members 222 and 226 are pressed into contact abutment with the bottom surface of the mount chamber 201*a* and the end surface of the plug 212, thus eliminating air gaps therebetween and also achieving hermetical isolation of the high-pressure regions from the low-pressure regions within the housing 201, respectively. This eliminates the undesirable leakage of hydraulic pressure within the housing 201 and minimizes the deterioration of durability of the annular rubber members 223 and 227 expected to arise from elastic deformation thereof into the air gaps. The pressure-exerted surface of the inner member 222 is, as described above, formed by the slant surface 222*d*, thus enhancing the conversion of the discharge pressure acting thereon into the thrust to move the inner member 222 away from the gear pump 19 to eliminate the air gap between the inner member 222 and the bottom of the mount chamber 201*a*. The same is true of the sealing mechanism 215.

The rise in discharge pressure from the gear pumps 19 and 39, as described above, results in an increase in pressure which presses the outer members 224 and 228 against the gear pumps 19 and 39, respectively, thus leading to an increase in loss of the torque required for the pumping operation of the gear pumps 19 and 39.

In order to alleviate the above problem, the inner members 222 and 226 are made of material which is greater in Young's modulus than the outer members 224 and 228, thereby resulting in a decrease in degree of pressure by which the outer members 224 and 228 are thrust against the gear pumps 19 and 39, respectively, and also resulting in a decrease in loss of the torque required for the pumping operation of the gear pumps 19 and 39.

Third Embodiment

The gear pump apparatus of this embodiment is different in structure of the inner members 112 and 116 of the sealing mechanisms 111 and 115 from the first and second embodiments. Other arrangements are identical, and explanation thereof in detail will be omitted here. The gear pump apparatus of this embodiment, like in the first embodiment, has the gear pumps 19 and 39 which are each implemented by the internal gear pump, but instead may be designed, like in the second embodiment, to have the external gear pumps. The following discussion will refer only to the inner member 112 for the brevity of disclosure, but the inner member 116 has the same structure as that of the inner member 112.

Figure 13A:
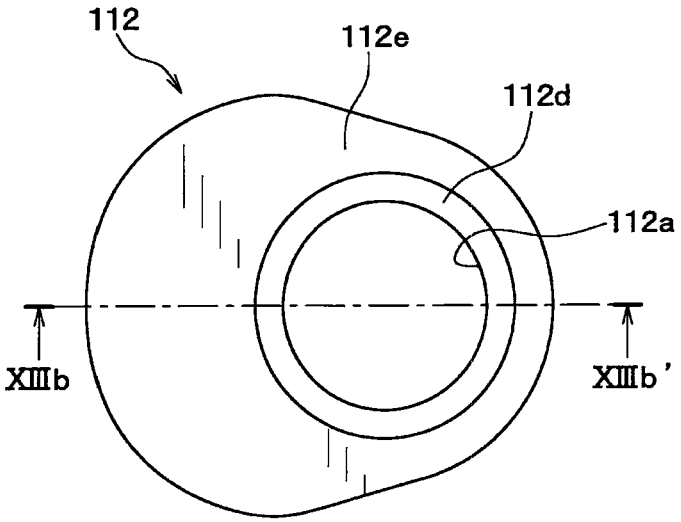
FIG. 13(*a*) is a front view which illustrates an inner member of a sealing mechanism installed in an internal gear pump according to the third embodiment.
Figure 13B:
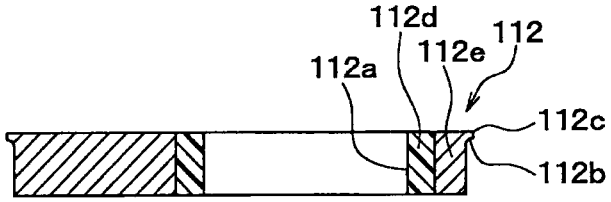

FIGS. 13(*a*) and 13(*b*) illustrate the structure of the inner member 112. The inner member 112 is made up of two parts: an annular inner cylinder 112*d* and an outer disc 112*e* in which the inner cylinder 112*d* is fit. The inner cylinder 112*d* and the outer disc 112*e* will also be referred to as an inner peripheral portion and an outer peripheral portion below. The inner cylinder 112*d* is made of resin and has an inner peripheral wall 112*a* to define a circular cavity through which the drive shaft 54 passes. The inner peripheral wall 112*a* has a sliding surface with which the outer periphery of the drive shaft 54 is in slidable contact. The outer disc 112*e* is made of metallic material, such as ferrous, SUS-based, aluminum-based, or copper-based material and has a sliding surface with which the outer member 114 is in slidable contact. The material of the outer disc 112*e* is greater in Young's modulus than the outer member 114. The assembling of the inner cylinder 112*d* and the outer disc 112*e* may be achieved using the insert molding techniques by inserting the outer disc 112*e* into a resin mold of the inner cylinder 112*d* or by fitting the inner cylinder 112*d* into a circular hole of the outer disc 112*e*.

The making of the inner cylinder 112*d* from resin material minimizes seizure or thermal sticking of the sliding surface thereof to the outer periphery of the drive shaft 54. The outer disc 112*e* is, as described above, made of material which is greater in Young's modulus than the outer member 114, thus producing the same beneficial effects as those described in the first embodiment.

Modification of Third Embodiment

Figure 14A:
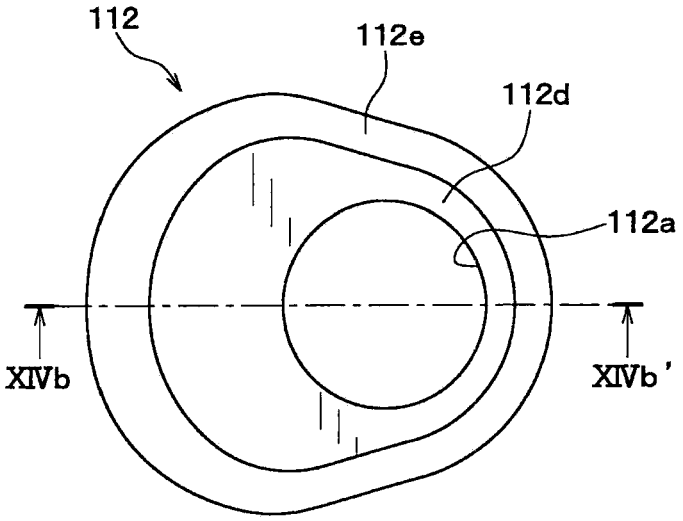
FIG. 14(*a*) is a front view which illustrates an inner member of a sealing mechanism in a modified form of the third embodiment.
Figure 14B:
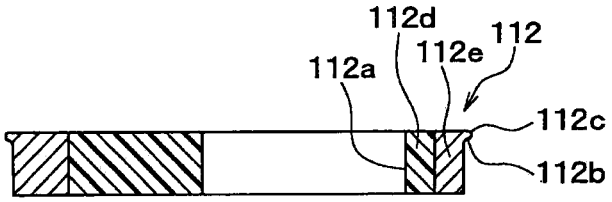

The inner member 112 may be made, as illustrated in FIGS. 14(*a*) and 14(*b*). Specifically, the inner cylinder 112*d* of FIG. 13(*a*) is circular in traverse section thereof, but may be designed, as can be seen from FIG. 14(*a*), to have an outer shape similar to that of the outer disc 112 of FIG. 13(*a*).

Fourth Embodiment

The gear pump apparatus of this embodiment is different in structure of the inner members 112 and 116 of the sealing mechanisms 111 and 115 from the first and second embodiments. Other arrangements are identical, and explanation thereof in detail will be omitted here. The gear pump apparatus of this embodiment, like in the first embodiment, has the gear pumps 19 and 39 which are each implemented by the internal gear pump, but instead may be designed, like in the second embodiment, to have the external gear pumps. The following discussion will refer only to the inner member 112 for the brevity of disclosure, but the inner member 116 has the same structure as that of the inner member 112.

Figure 15A:
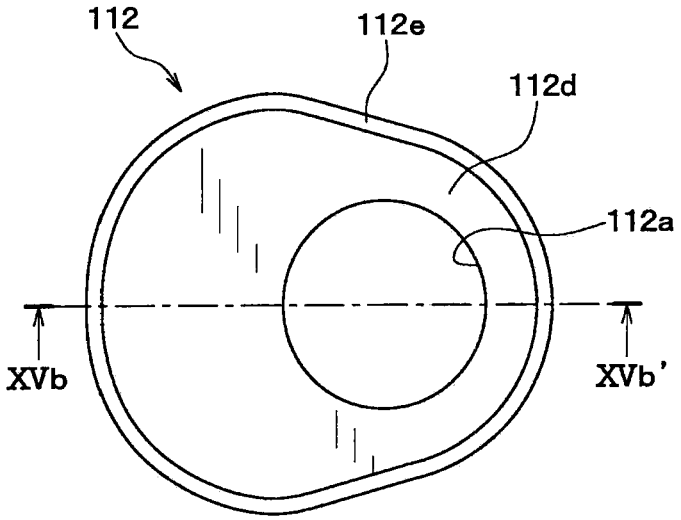
FIG. 15(*a*) is a front view which illustrates an inner member of a sealing mechanism installed in an internal gear pump according to the fourth embodiment.
Figure 15B:
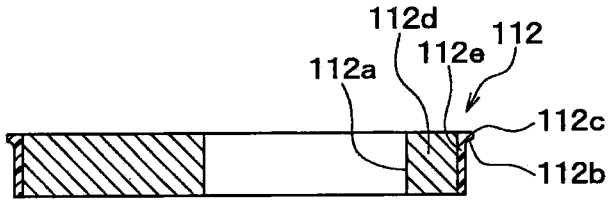

FIGS. 15(*a*) and 15(*b*) illustrate the structure of the inner member 112. The inner member 112 is made up of two parts: an inner plate 112*d* and an annular outer cylinder 112*e* in which the inner plate 112*d* is fit. The inner plate 112*d* and the outer cylinder 112*e* will also be referred to as an inner peripheral portion and an outer peripheral portion below.

The inner plate 112*d*, like in the third embodiment, has the inner peripheral wall 112*a* to define a circular cavity through which the drive shaft 54 passes. The inner peripheral wall 112*a* has a sliding surface with which the outer periphery of the drive shaft 54 is in slidable contact. The inner plate 112*d* is made of metallic material, such as ferrous, SUS-based, aluminum-based, or copper-based material. The outer cylinder 112*e* is made of a thin resin film in the form of an outer layer. When the inner member 112 is gripped, as described above, by the outer member 114, the degree to which the inner member 112 is elastically deformed by the gripping force F in FIG. 8 depends upon the thickness of the outer cylinder 112*e*. The inner plate 112*d* made of metal, thus, serves to absorb most of the gripping force F. The total amount by which an assembly of the inner plate 112*d* and the outer cylinder 112*e* is elastically deformed, therefore, become small. In other words, a total Young's modulus of the assembly of the inner plate 112*d* and the outer cylinder 112*e* will be greater than that of the outer member 114.

The materials of the outer plate 112*e* and the inner cylinder 112*e* are, as described above, opposite those in the third embodiment, but the inner member 112 has the Young's modulus greater than that of the outer member 114, thus producing substantially the same beneficial effects as in the first embodiment. The making of the outer cylinder 112*e* by the thin resin film results in an increase in friction coefficient μ between the outer periphery of the outer cylinder 112*e* and the outer member 114 placed in contact with the outer periphery of the outer cylinder 112*e* as compared with when the inner member 112 is made only from metal. This also results in an increase in braking force Fμ, as described in FIG. 8, thereby reducing the loss of torque required for the pumping operation of the gear pump 19. The same is true of the gear pump 39.

Modifications

The pressure-exerted surface of the inner member 112 of the sealing mechanism 111 to which the pressure, as produced by the deformation of the rubber member 113, is applied is, as described above, made by the slant surface 112*b* of the flange 112*c*. The flange 112*c* extends cover the whole of circumference of the inner member 112, but may be formed on at least a portion of the outer periphery of the inner member 112 or made up of one or more discrete protrusions formed on the outer periphery of the inner member 112 to define the pressure-exerted surface working as a pressure converter to convert the pressure exerted by the rubber member 113 into force to move the inner member 112 away from the gear pump 19 toward the inner surface of the wall of the housing 101 which is on the opposite side of the sealing mechanism 111 to the gear pump 19. The same is true of the inner members 116, 222, and 226.

The inner members 112, 116, 222, and 226 may have surfaces which contact with the outer members 114, 118, 224, and 228 and are roughed by shot blasting or hair line polishing to have irregularities formed thereon in order to increase the coefficient of friction μ between each of the inner members 112, 116, 222, and 226 and a corresponding one of the outer members 114, 118, 224, and 228. This results in an increase in braking force Fμ, as described in FIG. 8, thereby reducing the loss of torque required for the pumping operation of the gear pump 19. Such machining is easy to perform especially in the case where at least portions of the inner members 112, 116, 222, and 226 which contact with the outer members 114, 118, 224, and 228 are made of metal.

The inner members 112, 116, 222, and 226 are made of metal, as an example, in order to have the Young's modulus greater than that of the outer members 114, 118, 224, and 228 in the above embodiments, but may alternatively be made of another material, such as resin or ceramic, as long as it is greater in Young's modulus than the outer members 114, 118, 224, and 228.

Figure 16:
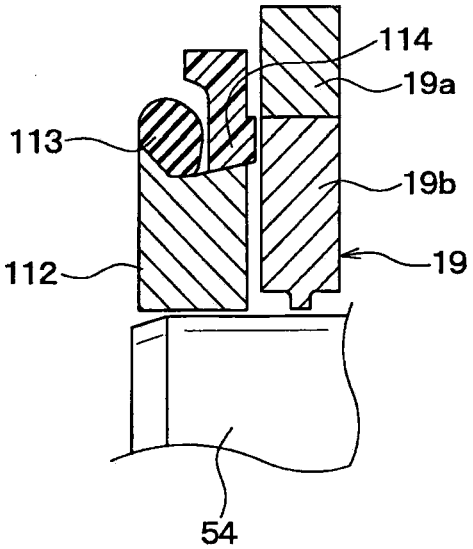
FIG. 16 is a partial sectional view which illustrates a modification of an inner member of a sealing mechanism.

The surfaces of the inner members 112, 116, 222, and 226 which are placed in contact with the outer members 114, 118, 224, and 228 are oriented parallel to the axis of the drive shaft in the above embodiments, but may alternatively be, as illustrated in FIG. 16, shaped to slant at a given angle to the axis of the drive shaft 54. In the illustrated example, the outer peripheral surface of the inner member 112 which is placed in contact with the outer member 114 has a slant area which is closer to the gear pump 19 than the slant area 112*b* is and where a distance between itself and the longitudinal center line of the drive shaft 54 (i.e., the axial center of the inner member 114), in other words, the radius of the inner member 114 increases as approaching the gear pump 19. This results in an increase in friction coefficient μ which serves as resistance to movement of the outer members 114, 118, 224, and 228 toward the gear pumps 19 and 39, thus increasing the braking force Fμ, as described in FIG. 8, to reduce the loss of torque required for the pumping operation of the gear pumps 19 and 39. The outer member 114 may preferably be shaped to have an inner periphery which is contoured to conform with the slant area of the inner member 112.

The gear pump apparatus of the first embodiment is, as described above, equipped with two internal gear pumps: the gear pumps 19 and 39 which include the outer rotors 19*a* and 39*a* (which are also referred to as first gears) and the inner rotors 19*b* and 39*b* (which are also referred to as second gears), while the gear pump apparatus of the second embodiment is equipped with two external gear pumps which include the drive gears 19*d* and 39*d* (which are also referred to as first gears) and the driven gears 19*e* and 39*e* (which are also referred to as second gears), but the gear pump apparatus may alternatively be designed to have only one gear pump which is either of the internal or external type. This eliminates the need for using an assembly of the housing 101 or 201, the cylinder 71 or 211, and the plug 72 or 212 as a casing which has formed therein the rotor chambers 100*a* and 100*b* in which the gear pumps 19 and 39 are mounted. In other words, only a member may be prepared as a casing for mounting the single gear pump.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A gear pump apparatus comprising:

a gear pump which includes a first gear and a second gear meshing with the first gear, the first and second gears being rotated through a drive shaft to suck and discharge fluid in a pumping operation;

a casing which has defined therein a chamber in which the first and second gears are mounted; and a sealing mechanism which is disposed between an outer wall of said casing and said gear pump, said sealing mechanism working to create a hermetical seal between a low-pressure region and a high-pressure region, the low-pressure region including an intake side of the gear pump into which the fluid is sucked and a peripheral region of the drive shaft, the high-pressure region including a discharge side from which the fluid is discharged, said sealing mechanism including an annular rubber member, an outer member, and an inner member, the annular rubber member surrounding the low-pressure region to create a hermetical seal between the low-pressure region and the high-pressure region, the outer member being placed outside the annular rubber member in contact with one of axial ends of each of the first and second gears of the pump, the inner member having an outer peripheral wall on which the annular rubber member is fit and being disposed inside the outer member, the inner member being arranged in contact with an inner surface of the outer wall of said casing, the inner surface being located on an opposite side of the inner member to said gear pump, the outer peripheral wall of the inner member having formed thereon a protrusion which is shaped to have a pressure-exerted surface to which pressure, as produced by deformation of the annular rubber member arising from application of discharge pressure of said gear pump, is applied to create thrust to move the inner member toward the inner surface of the outer wall of said casing, said protrusion also working to increase the thrust with an increase in pressure exerted by the annular rubber member on the pressure-exerted surface which arises from a rise in the discharge pressure, the inner member being greater in Young's modulus than the outer member.

2. A gear pump apparatus as set forth in claim 1, wherein the inner member is made of a one-piece metallic member, and wherein the outer member is made from resin material whose Young' modulus is smaller than that of the one-piece metallic member.

3. A gear pump apparatus as set forth in claim 1, wherein said inner member includes an inner peripheral portion and an outer peripheral portion disposed on an outer periphery of the inner peripheral portion, the inner peripheral portion having a sliding surface on which the drive shaft is slidable, wherein the inner peripheral portion is made from resin, and the outer peripheral portion is made from metal, and wherein the outer member is made from resin which is smaller in Young's modulus than the outer peripheral portion.

4. A gear pump apparatus as set forth in claim 2, wherein the inner member has a portion placed in contact with the outer member, the portion being roughed to have irregularities formed thereon.

5. A gear pump apparatus as set forth in claim 1, wherein said inner member is formed by an assembly of an inner peripheral portion and an outer peripheral portion disposed on an outer periphery of the inner peripheral portion, the inner peripheral portion having a sliding surface on which the drive shaft is slidable, wherein the inner peripheral portion is made from metal, and the outer peripheral portion is made of a thin resin film, and wherein the outer member is made from resin which has a Young's modulus smaller than a total Young's modulus of the assembly of the inner peripheral portion and the outer peripheral portion of the inner member.

6. A gear pump apparatus as set forth in claim 1, wherein the inner member has a surface which is placed in contact with the outer member and which has a slant area where a distance between itself and an axial center of the inner member increases as approaching the gear pump.

* * * * *